US012611574B2

(12) United States Patent
Aoki et al.

(10) Patent No.: US 12,611,574 B2
(45) Date of Patent: Apr. 28, 2026

(54) PROCESSING SYSTEM, PROCESSING METHOD, AND NON-TRANSITORY STORAGE MEDIUM

(71) Applicant: TOYOTA JIDOSHA KABUSHIKI KAISHA, Toyota (JP)

(72) Inventors: Eisuke Aoki, Toyota (JP); Yuko Nakahira, Nagakute (JP); Daisuke Yamada, Nagakute (JP); Hidekazu Nishigaki, Nagakute (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 222 days.

(21) Appl. No.: 17/903,323

(22) Filed: Sep. 6, 2022

(65) Prior Publication Data

US 2023/0149777 A1 May 18, 2023

(30) Foreign Application Priority Data

Nov. 12, 2021 (JP) ..... 2021-184938

(51) Int. Cl.
*A63B 24/00* (2006.01)

(52) U.S. Cl.
CPC .. *A63B 24/0087* (2013.01); *A63B 2024/0093* (2013.01); *A63B 2225/09* (2013.01)

(58) Field of Classification Search
CPC ..... A63B 24/0087; A63B 2024/0093; A63B 2225/09; A63B 22/0694; A63B 22/201; A63B 23/04; A63B 2208/0233; A63B 2220/17; A63B 2220/51; A63B 222/83; A63B 2225/50; A63B 22/0605; A63B 24/0075; A63B 22/04; A63B 2230/605
See application file for complete search history.

(56) References Cited

U.S. PATENT DOCUMENTS

2011/0077125 A1* 3/2011 Kenyon ..... A63B 22/0605 482/4
2011/0105962 A1 5/2011 Ochi et al.
2014/0100491 A1* 4/2014 Hu ..... A61H 3/008 601/23
2018/0353812 A1* 12/2018 Lannon ..... G16H 20/30
2022/0401794 A1* 12/2022 Bissonnette ..... G06N 20/00

FOREIGN PATENT DOCUMENTS

CN 113492942 A * 10/2021 ..... A61B 5/221
JP H10-094577 A 4/1998
JP 2004-173862 A 6/2004
JP 2007-037852 A 2/2007

* cited by examiner

*Primary Examiner* — Loan B Jimenez
*Assistant Examiner* — Jacqueline N L Loberiza
(74) *Attorney, Agent, or Firm* — Oliff PLC

(57) ABSTRACT

A processing system includes a processor. The processor is configured to: acquire user data including information on an activity of daily living a user is able to perform; calculate a recommended setting of training equipment that places a load on a muscle of the user, based on the user data; and output the recommended setting.

8 Claims, 16 Drawing Sheets

FIG. 8

| ACTIVITIES OF DAILY LIVING | RECOMMENDED SETTINGS | | |
|---|---|---|---|
| | INSTALLATION DISTANCE | PEDAL LOAD | ROTATIONAL SPEED |
| GO UP/DOWN STAIRS | LARGE | 5 | HIGH |
| WALK | LARGE | 4 | HIGH |
| WALK WITH ASSISTANCE | SMALL | 4 | HIGH |
| STAND UP | SMALL | 4 | MEDIUM |
| SIT DOWN | SMALL | 3 | MEDIUM |
| STAND UP AND SIT DOWN WITH ASSISTANCE | NORMAL | 3 | MEDIUM |
| STAND | NORMAL | 2 | MEDIUM |
| STAND WITH ASSISTANCE | NORMAL | 1 | MEDIUM |
| SIT STABLY | NORMAL | 1 | LOW |

PROCESSING SYSTEM, PROCESSING METHOD, AND NON-TRANSITORY STORAGE MEDIUM

CROSS-REFERENCE TO RELATED APPLICATION

This application claims priority to Japanese Patent Application No. 2021-184938 filed on Nov. 12, 2021, incorporated herein by reference in its entirety.

BACKGROUND

1. Technical Field

The present disclosure relates to a processing system, processing method, and non-transitory storage media.

2. Description of Related Art

Japanese Unexamined Patent Application Publication No. H10-94577 (JP H10-94577 A) discloses a pedal-type foot sole massager. When using this massager, a user pedals with his or her feet while sitting on a chair.

SUMMARY

A user performs a pedaling exercise in order to maintain or increase muscular strength. Exercise equipment like pedal exercisers are desired to allow users to exercise more effectively. For example, by setting an appropriate load level for the user, the user can do training suitable for him or her.

The present disclosure provides a processing system, processing method, and non-transitory storage medium that allow a user to train efficiently.

A processing system according to an embodiment includes a processor. The processor is configured to: acquire user data including information on an activity of daily living a user is able to perform; calculate a recommended setting of training equipment that places a load on a muscle of the user, based on the user data; and output the recommended setting.

In the processing system according to the embodiment, the processor may be configured to: calculate an upper limit of the load that is placed on the muscle of the user, based on the activity of daily living the user is able to perform; and calculate the recommended setting of the training equipment based on the upper limit of the load.

In the processing system according to the embodiment, the user data may include physical information of the user. The processor may be configured to obtain the upper limit of the load from a simulation result of a load that is placed on a muscle site or joint when the user performs the activity of daily living.

In the processing system according to the embodiment, the training equipment may be a pedal exerciser with which the user performs a pedaling exercise while sitting on a seat portion. The processor may be configured to set the recommended setting in such a way that a load obtained by simulating the pedaling exercise is not higher than the upper limit.

In the processing system according to the embodiment, the processor may be configured to calculate load resistance of a pedal for the pedaling exercise and a recommended setting for setting an installation distance from a rotating shaft to the seat portion for the pedaling exercise.

In the processing system according to the embodiment, the processor may be configured to determine whether the training equipment is operating with the recommended setting.

A processing method according to an embodiment includes: acquiring user data including information on an activity of daily living a user is able to perform; calculating a recommended setting of training equipment that places a load on a muscle of the user, based on the user data; and outputting the recommended setting.

The processing method according to the embodiment may further include: calculating an upper limit of the load that is placed on the muscle of the user, based on the activity of daily living the user is able to perform; and calculating the recommended setting of the training equipment based on the upper limit of the load.

The processing method according to the embodiment may further include obtaining the upper limit of the load from a simulation result of a load that is placed on each of a muscle site or joint when the user performs the activity of daily living. The user data may include physical information of the user.

The processing method according to the embodiment may further include setting the recommended setting in such a way that a load obtained by simulating a pedaling exercise is not higher than the upper limit. The training equipment may be a pedal exerciser with which the user performs the pedaling exercise while sitting on a seat portion.

The processing method according to the embodiment may further include calculating load resistance of a pedal for the pedaling exercise and a recommended setting for setting an installation distance from a rotating shaft to the seat portion for the pedaling exercise.

The processing method according to the embodiment may further include determining whether the training equipment is operating with the recommended setting.

A non-transitory storage medium according to an embodiment stores instructions that are executable by one or more processors and that cause the one or more processors to perform functions. The functions include: acquiring user data including information on an activity of daily living a user is able to perform; calculating a recommended setting of training equipment that places a load on a muscle of the user, based on the user data; and outputting the recommended setting.

In the non-transitory storage medium according to the embodiment, the functions may further include: calculating an upper limit of the load that is placed on the muscle of the user, based on the activity of daily living the user is able to perform; and calculating the recommended setting of the training equipment based on the upper limit of the load.

In the non-transitory storage medium according to the embodiment, the user data may include physical information of the user. The functions may further include obtaining the upper limit of the load from a simulation result of a load that is placed on a muscle site or joint when the user performs the activity of daily living.

In the non-transitory storage medium according to the embodiment, the training equipment may be a pedal exerciser with which the user performs a pedaling exercise while sitting on a seat portion. The functions may further include setting the recommended setting in such a way that a load obtained by simulating the pedaling exercise is not higher than the upper limit.

In the non-transitory storage medium according to the embodiment, the functions may further include calculating load resistance of a pedal for the pedaling exercise and a recommended setting for setting an installation distance from a rotating shaft to the seat portion for the pedaling exercise.

In the non-transitory storage medium according to the embodiment, the functions may further include determining whether the training equipment is operating with the recommended setting.

The present disclosure provides a processing system, processing method, and non-transitory storage media that allow a user to train effectively.

BRIEF DESCRIPTION OF THE DRAWINGS

Features, advantages, and technical and industrial significance of exemplary embodiments of the present disclosure will be described below with reference to the accompanying drawings, in which like signs denote like elements, and wherein:

FIG. 8 shows an example of a recommended setting table;

DETAILED DESCRIPTION OF EMBODIMENTS

Hereinafter, the present disclosure will be described through an embodiment. However, the present disclosure according to the claims is not limited to the following embodiment. Not all of the configurations described in the embodiment are essential as means for solving the problem. For the sake of clarity, the following description and drawings are omitted or simplified as appropriate. The same elements are denoted by the same reference signs throughout the drawings, and duplicate descriptions will be omitted as necessary.

First Embodiment

In the present embodiment, a pedal exerciser will be described as an example of the training equipment. The training equipment is a pedal exerciser (hereinafter sometimes simply referred to as the "exerciser") for a user to perform a pedaling exercise. A processing system and processing method according to the present embodiment perform a process of providing recommended settings of setting items for equipment for training with a pedal exerciser. For example, the processing system outputs recommended settings to a person who performs a pedaling exercise and an assistant who assists in the training. The person who performs a pedaling exercise can thus train under appropriate load.

Figure 1:
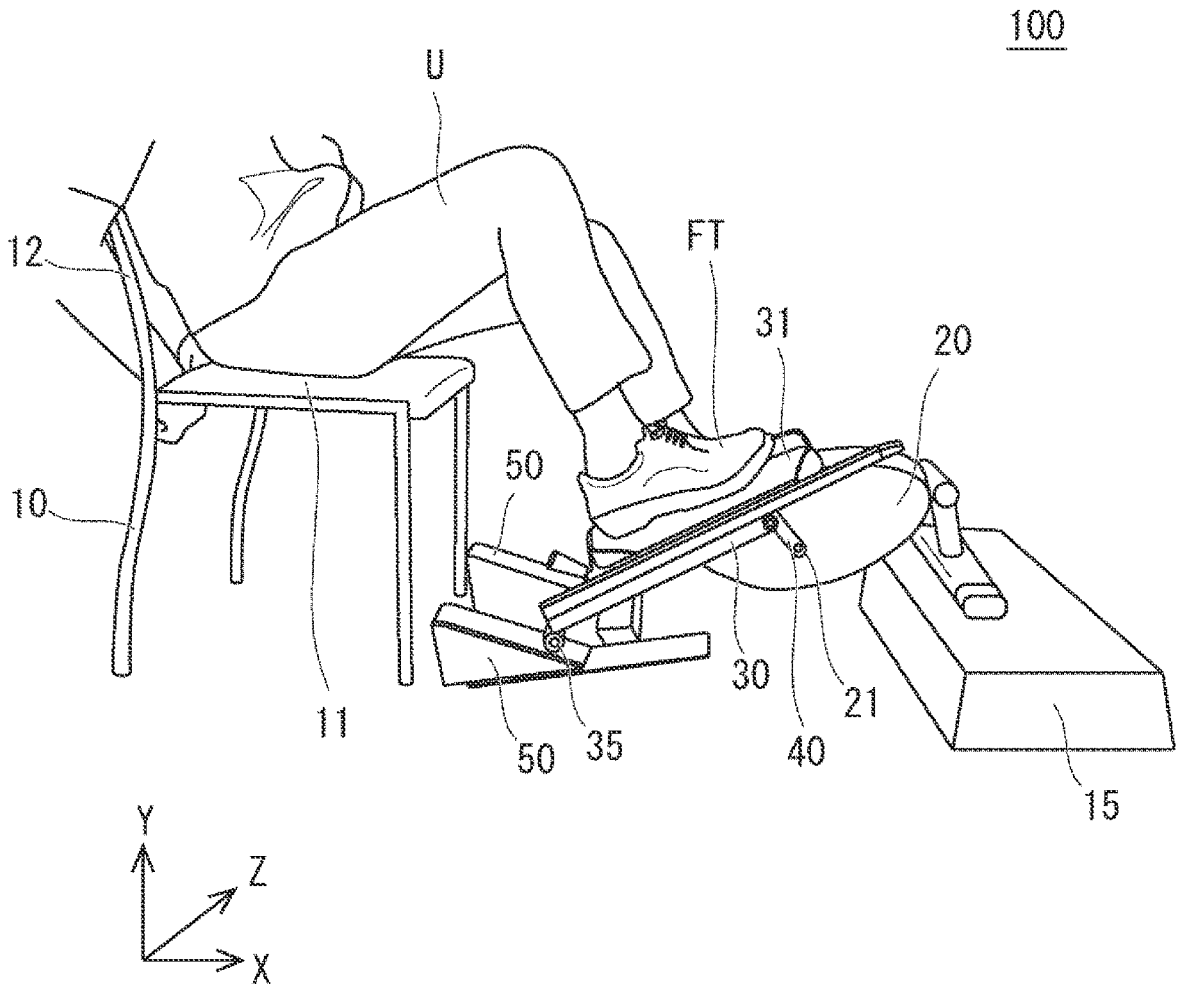
FIG. 1 is a perspective view schematically showing a configuration of an exerciser.
Figure 2:
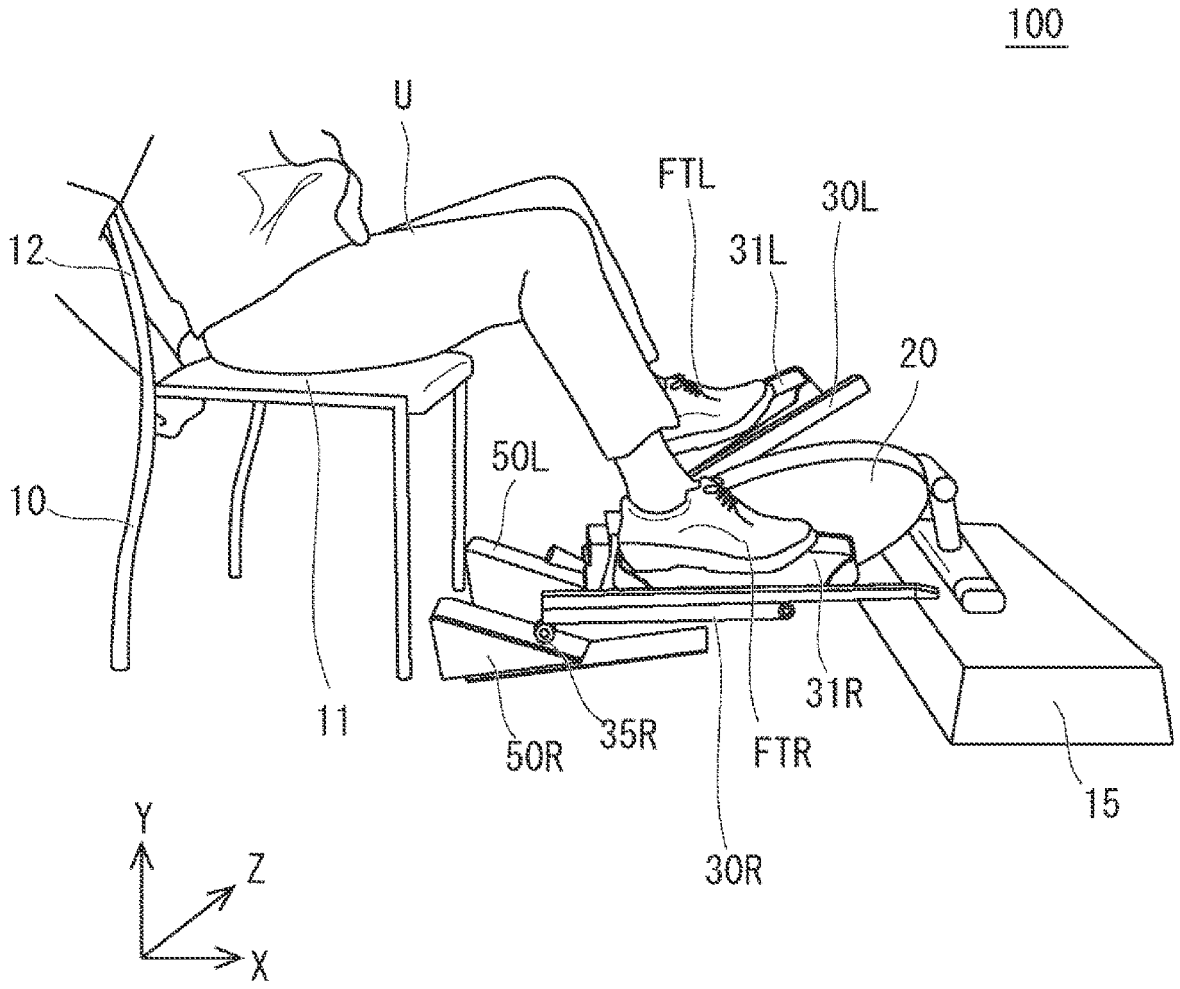
FIG. 2 is a perspective view schematically showing the configuration of the exerciser.

An exerciser 100 will be described with reference to FIGS. 1 and 2. FIGS. 1 and 2 show the exerciser 100 as viewed from the side. For clarity of explanation, the following description will be given using a three-dimensional XYZ Cartesian coordinate system. Specifically, the +X direction is an anterior (forward) direction, the −X direction is a posterior (backward) direction, the +Y direction is a superior (upward) direction, the −Y direction is an inferior (downward) direction, the +Z direction is a left direction, and the −Z direction is a right direction. The anteroposterior (front-back) direction, the lateral (left-right) direction, and the vertical (up-down) direction are based on the directions with respect to a user U.

The exerciser 100 can adjust the range of motion of the ankle joint. In the following description, the rotational direction of the ankle joint about the Z axis is referred to as the "plantar/dorsal flexion direction," and the angle of this rotation is referred to as the "plantar/dorsal flexion angle." More specifically, the direction in which the toes of a foot FT are moved downward is referred to as the "plantarflexion direction," and the direction in which the toes of the foot FT are moved upward is referred to as the "dorsiflexion direction."

As shown in FIG. 1, the exerciser 100 includes a main body 20, a link 30, a crank 40, and a tilted base 50. A chair 10 is placed behind the exerciser 100. The user U sits on the chair 10 and performs a pedaling exercise. The chair 10 therefore serves as a seating portion on which the user U sits. The chair 10 may be integral with the exerciser 100, or may be a separate member from the exerciser 100. For example, the chair 10 may be a chair in a facility or home where the user U is located. That is, the user U or the assistant may place the chair 10 behind the exerciser 100.

The chair 10 includes a seat portion 11 that serves as a seating portion and a backrest portion 12. The backrest portion 12 supports the back of the user U sitting on the seat portion 11. That is, the user U can perform a pedaling exercise while leaning against the backrest portion 12. The chair 10 can be replaced or adjusted for the individual user U. For example, a user U who does heavier load training can use a chair 10 with no backrest portion 12. Alternatively, the backrest portion 12 may have a reclining mechanism. The angle of the backrest portion 12 may be adjusted by the reclining mechanism.

In the exerciser 100, components attached to the main body 20 are symmetrically. In FIG. 2, in order to distinguish between the right and left components, reference signs for the components on the right side of the main body 20 have the letter "R" at the end, and reference signs for the components on the left side of the main body 20 have the letter "L" at the end. For example, in FIG. 2, the left tilted base 50 is shown as a tilted base 50L, and the right tilted base 50 is shown as a tilted base 50R. Similarly, the left link 30 is shown as a link 30L, the left pedal 31 is shown as a pedal 31L, the right link 30 is shown as a link 30R, and the right pedal 31 is shown as a pedal 31R. Similarly, the left foot FT is shown as a left foot FTL, and the right foot FT is shown as a right foot FTR. In the following description, the letters "R" and "L" will be omitted when the right and left components are not distinguished from each other.

The main body 20 rotatably holds the crank 40. For example, the main body 20 is provided with a rotating shaft 21. The crank 40 is connected to the rotating shaft 21. The crank 40 rotates about the rotating shaft 21. The main body 20 may have a load resistor that applies a load to the rotational motion of the crank 40. The main body 20 may have a gear etc. that can change the load.

The main body 20 is placed on an installation base 15. The installation base 15 is placed on the floor surface. For example, the front (anterior) part of the main body 20 is located on the installation base 15, and the back (posterior) part of the main body 20 is located on the floor surface. The installation angle of the main body 20 can be changed by changing the height, position, etc. of the installation base 15. For example, the main body 20 is placed horizontally by removing the installation base 15. The installation angle of the main body 20 is made steep by raising the installation base 15. The posture of the user U during training is thus changed by changing the height of the installation base 15 or removing the installation base 15. The user U's joint range of motion by training can thus be adjusted.

The distance between the main body 20 and the chair 10 in the anteroposterior direction may be changed according to the user U. For example, the user U can place the chair 10 near the main body 20. In this case, the user U performs a pedaling exercise with his or her knee joints etc. relatively flexed. Alternatively, the user U can place the chair 10 far from the main body 20. In this case, the user U trains with his or her knee joints etc. relatively extended. The posture of the user U during training is thus changed by changing the distance between the main body 20 and the chair 10 in the X direction. The user U's joint range of motion by training can thus be adjusted.

The link 30 includes a pedal 31 and a sliding wheel 35. The crank 40 is connected to the front (anterior) end of the link 30, and the sliding wheel 35 is connected to the back (posterior) end of the link 30. The crank 40 and the link 30 are rotatably connected to each other. For example, the link 30 is attached to the crank 40 via a bearing etc. The pedal 31 is attached to an intermediate position on the link 30. The pedal 31 is a step (footrest) on which the user U places his or her foot FT. The seated user U places his or her foot FT on the pedal 31.

The sliding wheel 35 is attached to the link 30 via a rotating shaft (axle). That is, the link 30 rotatably holds the sliding wheel 35. The sliding wheel 35 is a sliding member that slides on a tilted surface of the tilted base 50.

The user U performs a pedaling exercise with his or her foot FT on the pedal 31. That is, the user U moves his or her knee joint, hip joint, and ankle joint so as to step on the pedal 31. As a result, the crank 40 rotates about the rotating shaft 21. The angle between the link 30 and the crank 40 changes according to the rotation of the crank 40. That is, the relative angle of the link 30 with respect to the crank 40 changes according to the rotation angle of the crank 40 (also referred to as the "crank angle"). The sliding wheel 35 moves in the anteroposterior direction in contact with the tilted surface. The crank 40 and the link 30 therefore rotate according to the pedaling motion so that the pedal 31 follows an elliptical trajectory.

The pedal 31, the sliding wheel 35, the link 30, the crank 40, and the tilted base 50 are provided for each of the right and left feet FT of the user U. That is, the pedal 31, the sliding wheel 35, the link 30, the crank 40, and the tilted base 50 are provided on the right and left sides of the main body 20. The pedal 31R, the sliding wheel 35R, the link 30R, the tilted base 50R, etc. that are provided on the right side of the main body 20 are for the right foot FTR of the user U. The pedal 31L, the link 30L, the tilted base 50L, etc. provided on the left side of the main body 20 are for the left foot FTL of the user U.

The crank 40 is attached to the rotating shaft 21 of the main body 20 so as to be in antiphase between the right and left feet FT. That is, the rotation angle of the crank 40 for the left foot and the rotation angle of the crank 40 for the right foot are shifted by 180°. The user U performs a pedaling exercise by alternately bending and extending his or her right and left legs.

The sliding wheel 35 is attached to the lower end of the link 30. The sliding wheel 35 has a wheel that slides on the tilted surface of the tilted base 50. The tilted base 50 has a tilted surface that is tilted upward toward the back (posterior). The sliding wheel 35 reciprocates in the X direction (anteroposterior direction) according to the rotational motion of the link 30. As shown in FIG. 2, when the user U is pedaling in such a direction that his or her right leg is extended and his or her left leg is bent, the right sliding wheel 35 moves forward (anteriorly) and the left sliding wheel 35 moves backward (posteriorly). As shown in FIG. 1, when the user U is pedaling in such a direction that his or her left leg is extended and his or her right leg is bent, the left sliding wheel 35 moves forward (anteriorly) and the right sliding wheel 35 moves backward (posteriorly).

The height of the sliding wheel 35 changes along the tilted surface of the tilted base 50. The tilted surface of the tilted base 50 becomes higher toward the back (posterior). That is, the tilted base 50 is an uphill for the sliding wheel 35 moving backward (posteriorly). Therefore, the height of the sliding wheel 35 gradually increases as the sliding wheel 35 moves backward (posteriorly). The height of the sliding wheel 35 gradually decreases as the sliding wheel 35 moves forward (anteriorly). The angle of the link 30 is determined according to the height of the sliding wheel 35.

The angle of the pedal 31 located on the link 30 is limited according to the height of the sliding wheel 35. That is, the pedal 31 rotates in the plantarflexion direction as the height of the sliding wheel 35 increases. The pedal 31 rotates in the dorsiflexion direction as the height of the sliding wheel 35 decreases. Therefore, the range of motion for plantarflexion and dorsiflexion of the ankle joint can be adjusted according to the tilt angle of the tilted base 50. The range of motion for plantarflexion and dorsiflexion of the ankle joint can be adjusted according to the rotation angle of the crank 40.

The user U performs a pedaling exercise with the exerciser 100 for training. That is, the pedaling exercise can place a load on the muscles of the lower limbs and trunk of the user U. The muscles that can be built with the exerciser 100 include erector spinae (PS), rectus abdominis (RA), external abdominal oblique (OEA), hip flexor group (HF), gluteus maximus (GM), rectus femoris (RF), tibialis anterior (TA), soleus (SOL), gastrocnemius (MG), vastus medialis (VM), and hamstring (MH). The user U or the assistant can specify one or more muscle sites the user U wants to build.

Setting Items

Parameters for various setting items can be set in the exerciser 100. The user U etc. changes the parameter of each setting item, so that the user U can train effectively. By changing the parameter of each setting item of the exerciser 100, the user U can adjust the muscle site that can be built by the pedaling exercise and the amount of load to be placed on the muscle site. This allows effective training. The parameter of each setting item need not necessarily be set by the user U who trains, but may be set by the assistant who assists the user U in the training. The assistant may be, for example, a physical therapist or an occupational therapist.

The setting items of the exerciser 100 include, for example, the rotational speed of the crank 40, the amount of load of the crank 40, and the rotational direction of the crank 40. For example, a heavy load can be placed on muscles by increasing the rotational speed of the crank 40 or increasing the amount of load of the crank 40. The muscle site to which a load is placed can be changed by changing the rotational direction of the crank 40.

Other setting items include setting items for changing the geometrical arrangement of the exerciser 100. Such setting items include the distance between the chair 10 and the main body 20 in the anteroposterior direction, the installation angle (tilt angle) of the main body 20, the tilt angle of the pedal 31, the tilt angle of the tilted base 50, and the position of the tilted base 50 in the anteroposterior direction. The range of motion angle of the ankle joint can be changed according to the position of the tilted base 50 in the anteroposterior direction and the tilt angle of the tilted base 50. The ranges of motion angle of the knee joint and the hip joint are also changed by changing the distance between the main body 20 and the chair 10 in the anteroposterior direction, the tilt angle of the main body 20, etc. That is, the posture etc. during training can be changed by changing the parameters of the setting items. The muscle site the user U wants to build and the amount of load to be placed on the muscle site can be adjusted by changing the parameters of such setting items.

Other setting items include with or without the backrest portion 12. For example, a chair 10 with a detachable backrest portion 12 is prepared, and the backrest portion 12 may be removed when the user U is going to do heavy load training. Alternatively, a chair 10 with a backrest portion 12 and a chair 10 with no backrest portion 12 may be prepared, and the chair 10 may be replaced according to the training. As described above, a plurality of chairs 10 may be prepared, and the chair 10 may be replaced according to the training.

Other setting items include setting items that do not involve adjustment, change, or replacement in the exerciser 100. Such setting items may be, for example, the posture and motion of the user U. Specific examples of such setting items include with or without crossed arms and with or without arm swinging motion. For example, the user U can change the setting item by selecting either with or without arm swinging motion while performing a pedaling exercise. Alternatively, the user U can change the parameter by selecting with or without cross arms. In this way, the muscle site to be build can be changed according to the posture or motion of the user U.

Various setting items can be set in the exerciser 100. In other words, an appropriate load can be placed on each muscle site by appropriately setting the parameters of the setting items. That is, a desired load can be placed on each muscle site. For example, a heavy load can be placed on the muscle site the user U etc. wants to mainly build. Alternatively, the load can be reduced or the range of motion angle can be limited for the injured part.

As described above, the setting items include items that can be set as numerical parameters such as speed, angle, and relative position. Alternatively, the setting items include items that can be set in levels such as high, medium, and low levels. The setting items further include items that can be set by with or without equipment and with or without operation. The setting items further include items whose settings can be changed by arrangement of the equipment and replacement of the equipment. The setting items further include items whose settings can be changed by the training posture or training motion of the user. For example, for some setting items, with or without operation or with or without equipment can be used as a parameter.

Figure 3:
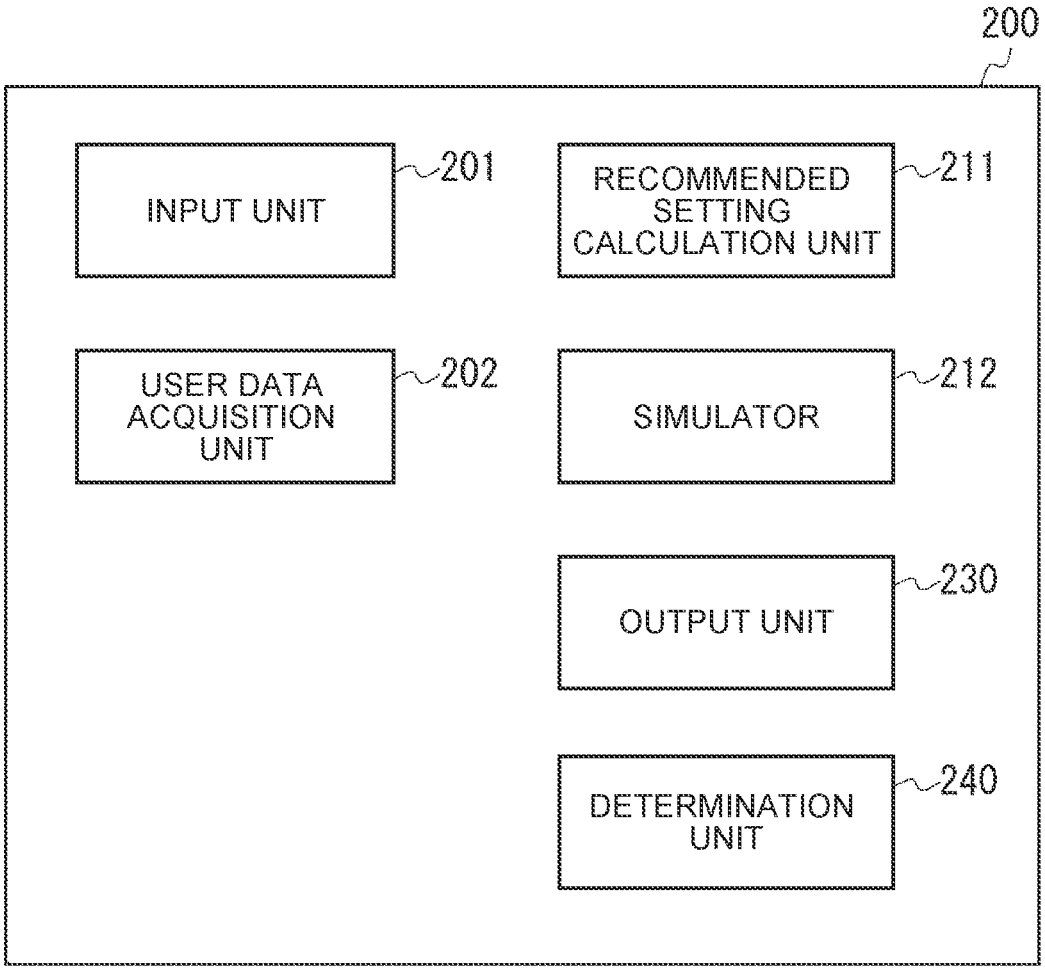
FIG. 3 is a block diagram showing a configuration of a processing system according to an embodiment.

A processing system that can output recommended settings for the above setting items will be described. FIG. 3 is a block diagram illustrating a configuration of a processing system 200. The processing system 200 includes an input unit 201, a user data acquisition unit 202, a recommended setting calculation unit 211, a simulator 212, an output unit 230, and a determination unit 240.

The processing system 200 may be, for example, a personal computer including a processor and a memory. The processing system 200 therefore stores a processing program in advance. The processing system 200 can perform a process, which will be described later, by the processor executing the program.

The input unit 201 includes an input device such as touch panel, keyboard, or mouse. The user U or the assistant (hereinafter collectively referred to as the user U etc.) can enter various kinds of information by operating the input unit 201. Alternatively, the input unit 201 may have a microphone etc. for voice input.

The user data acquisition unit 202 acquires user data on the user U who trains. The user data includes physical information of the user U. For example, the user data include the height, weight, lower limb length, upper limb length, trunk length, etc. of the user U. The user data is not limited to the physical features, but may include other features such as age and gender.

For example, the user U etc. enters numerical values such as height by operating the input unit 201. The user data acquisition unit 202 thus acquires the user data of the user U. Alternatively, the user data acquisition unit 202 may read the user data from the memory etc. For example, it is herein assumed that user identifications (user IDs) and user data are linked to each other and stored in the memory etc. The processing system 200 may store a user table in which user data such as height is linked to the user IDs for each user. In this case, when the user U etc. enters the user ID, the user data acquisition unit 202 reads the user data the corresponding to the user ID from the memory.

The user data acquisition unit 202 also acquires user data including information on the activities of daily living of the user U. For example, the user data includes information indicating whether the user U can perform the activities of daily living. It is herein assumed that the user U is an injured person, a sick person, a rehabilitation patient, an old person, etc. In this case, the user U cannot perform a part of the activities of daily living due to injury, illness, aging, etc. Therefore, when the user U etc. enters whether the user can perform the activities of daily living, the user data acquisition unit 202 acquires the user data including information on the activities of daily living. The processing system 200 may store a user table in which the information related to the activities of daily living is linked to the user ID. In this case, when the user U etc. enters the user ID, the user data acquisition unit 202 reads the corresponding user data from the memory.

The activities of daily living include going up/down the stairs, walking, walking with assistance, standing up, sitting down, standing up and sitting down with assistance, standing, standing with assistance, and sitting stably. For example, the user data includes information indicating whether the user can go up/down the stairs, whether the user can walk, whether the user can walk with assistance, whether the user can stand up, and whether the user can sit down. The user data further includes information indicating whether the user can stand up and sit down with assistance, whether the user can stand, whether the user can stand with assistance, and whether the user can sit stably.

The motion of going up/down the stairs herein refers to the motion of walking on the stairs, namely the motion of going up the stairs or the motion of going down the stairs. The motion of walking is a motion of walking on a flat floor surface without assistance of a helper. The motion of walking with assistance is a motion of walking on a flat floor surface with assistance of a helper. The motion of walking with assistance may be a motion of waking with assistance of a walker or cane. The motion of standing up is a motion of standing up from a sitting position on a chair. The motion of sitting down is the motion of sitting on a chair from a standing position. The motion of standing up and sitting down with assistance is a motion of standing up and sitting down with assistance of a helper. Standing is a motion of maintaining a standing posture. Standing with assistance is a motion of maintaining a standing posture with assistance of a helper. Sitting stably is a motion of stably maintaining a sitting posture.

The level of difficulty varies depending on the activities of daily living. For example, the level of difficulty of going up/down the stairs is the highest, followed by walking, walking with assistance, standing up and sitting down, standing up and sitting down with assistance, standing, standing with assistance, and sitting stably. Therefore, the activities of daily living the user can perform vary depending on the muscular strength of the user etc.

The user data may not include information indicating whether the user U can perform every single one of the activities of daily living. For example, the user data need only include information indicating whether the user U can perform one or more activities of daily living. It is preferable that what activities of daily living the user can perform and what activities of daily living the user cannot perform be known. For example, it is preferable that the user data include information indicating that the user can walk but cannot go up/down the stairs. That is, it is preferable that the user data include information indicating to what level of difficulty of activities of daily living the user can perform.

The recommended setting calculation unit 211 calculates recommended settings for the setting items based on the user data. The recommended setting calculation unit 211 obtains recommended settings based on the information on the activities of daily living the user can perform. In the recommended settings, an optimal parameter is set for each setting item.

Setting Items

Hereinafter, specific examples of the setting items will be described. Next, the setting items related to the geometrical arrangement for changing the pedaling posture of the user U will be described. FIGS. 4A to 7B are side views showing the postures of the user U. Some configurations are not illustrated in FIGS. 4A to 7B. For example, in FIG. 4A, only the pedal 31 and the link 30 of the exerciser 100 are illustrated, and illustration of the configurations such as the main body 20, the installation base 15, and the crank 40 is omitted as appropriate.

Figure 4A:
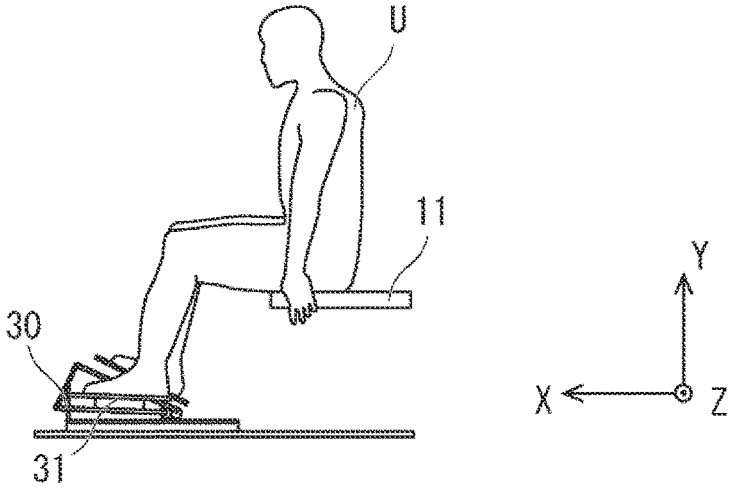
FIG. 4A shows the user's posture when the distance between a chair and a main body in an anteroposterior direction is normal.
Figure 4B:
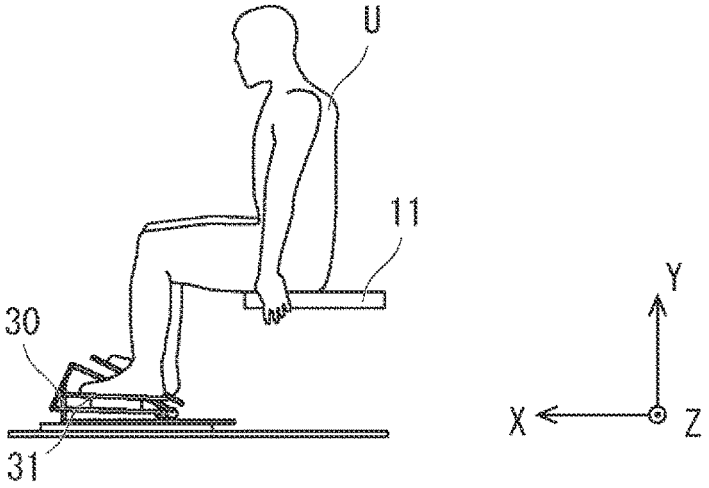
FIG. 4B shows the user's posture when the distance between the chair and the main body in the anteroposterior direction is small.
Figure 4C:
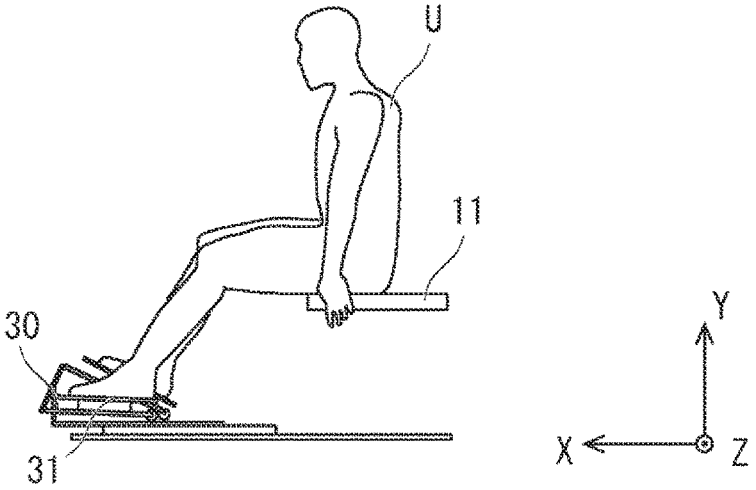
FIG. 4C shows the user's posture when the distance between the chair and the main body in the anteroposterior direction is large.

FIGS. 4A to 4C show the postures with different installation distances between the main body 20 and the chair 10 in the anteroposterior direction. FIG. 4A shows the posture when the installation distance of the chair 10 to the main body 20 in the X direction is normal. FIG. 4B shows the posture when the installation distance of the chair 10 to the main body 20 in the X direction is small. FIG. 4C shows the posture when the installation distance of the chair 10 to the main body 20 in the X direction is large. When the setting item is the installation distance between the main body 20 and the chair 10, the parameter of this setting item is classified into three levels: large distance, normal distance, and small distance. That is, for the setting item regarding the installation distance between the main body 20 and the chair 10, the recommended setting calculation unit 211 recommends one of large distance, normal distance, and small distance, as a recommended setting.

The installation distance (distance in the anteroposterior direction) between the main body 20 and the chair 10 is changed by changing the position of either or both of the chair 10 and the main body 20. The knee extension angle can be increased to the extension side by moving the chair 10 farther away from the main body 20. The ranges of motion of the knee joint, the ankle joint, etc. can be adjusted according to the distance between the main body 20 and the chair 10. The muscle site that can be built by training and the amount of the load to be placed on the muscle site can thus be changed.

Figure 5A:
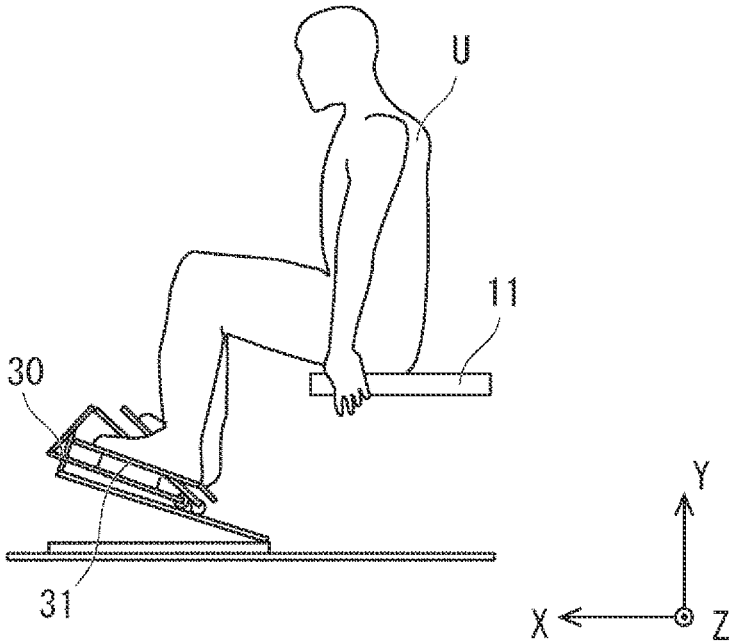
FIG. 5A shows the user's posture when the main body is tilted by placing an installation base and the distance between the chair and the main body in the anteroposterior direction is normal.
Figure 5B:
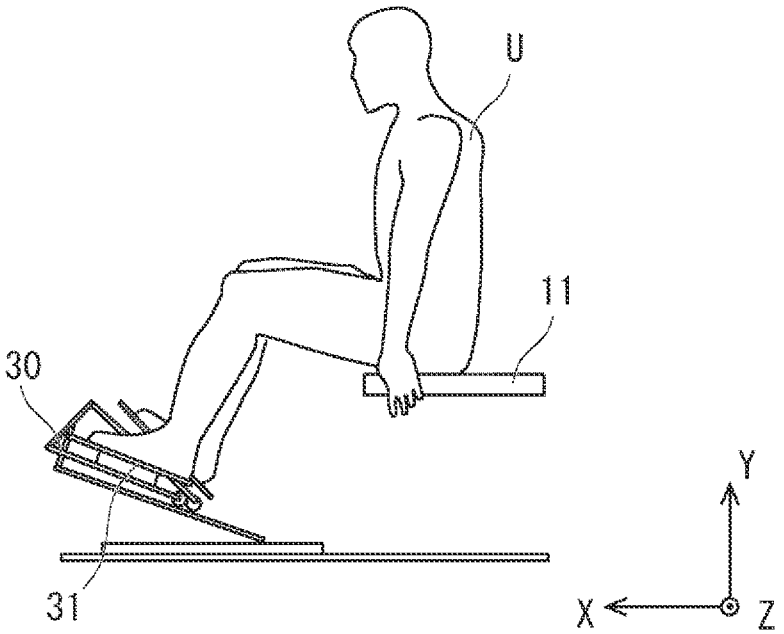
FIG. 5B shows the user's posture when the main body is tilted by placing the installation base and the distance between the chair and the main body in the anteroposterior direction is large.

FIGS. 5A and 5B show the user's postures when the installation angle of the main body 20 is tilted. FIG. 5A shows the posture when the distance of the chair 10 to the main body 20 is normal. FIG. 5B shows the posture when the distance of the chair 10 to the main body 20 is large. For example, the installation angle (tilt angle) of the main body 20 can be changed by attaching or detaching the installation base 15 shown in FIGS. 1 and 2. In FIGS. 5A and 5B, the main body 20 is placed on the installation base 15 so that the front (anterior) part of the main body 20 is located higher than in FIGS. 4A to 4C. That is, the main body 20 is tilted downward toward the back (posterior) by placing the main body 20 on the installation base 15. The ranges of motion of the knee joint, the ankle joint, etc. can be adjusted according to the installation angle of the main body 20. The ankle joint can be flexed in the dorsiflexion direction by increasing the tilt angle of the main body 20.

Therefore, the posture of the user U changes according to the installation angle of the main body 20. The main body 20 is located horizontally in FIGS. 4A to 4C, and the main body 20 is located in a tilted manner in FIGS. 5A and 5B. The ranges of motion of the knee joint, the ankle joint, etc. can be adjusted according to the presence or absence of the installation base 15. When the setting item is the installation angle of the main body 20, the parameter of this setting item is classified into two levels, "main body tilt" and "no main body tilt." That is, for the setting item regarding the installation angle of the main body 20, the recommended setting calculation unit 211 recommends either "main body tilt" or "no main body tilt" as a recommended setting. The muscle site that can be built by training and the amount of the load to be placed on the muscle site can thus be changed.

The angles of the knee joint, the ankle joint, etc. also change according to the installation angle of the main body 20. Therefore, the ranges of motion of the knee joint, the ankle joint, etc. can be finely adjusted by providing many settings of the installation angle of the main body 20. That is, the recommended setting calculation unit 211 recommends a numerical value or numerical range of the tilt angle of the main body 20 as a recommended setting. Alternatively, the recommended setting calculation unit 211 may recommend a numerical value or numerical range of the height or installation position of the main body 20 as a recommended setting. The posture and load can thus be set more finely. The muscle site that can be built by training and the amount of load to be placed on the muscle site can be changed by the tilt angle of the main body 20 and the installation base 15. That is, the tilt angle of the main body 20 can be changed according to the presence or absence of the installation base 15 shown in FIG. 1.

Figure 6A:
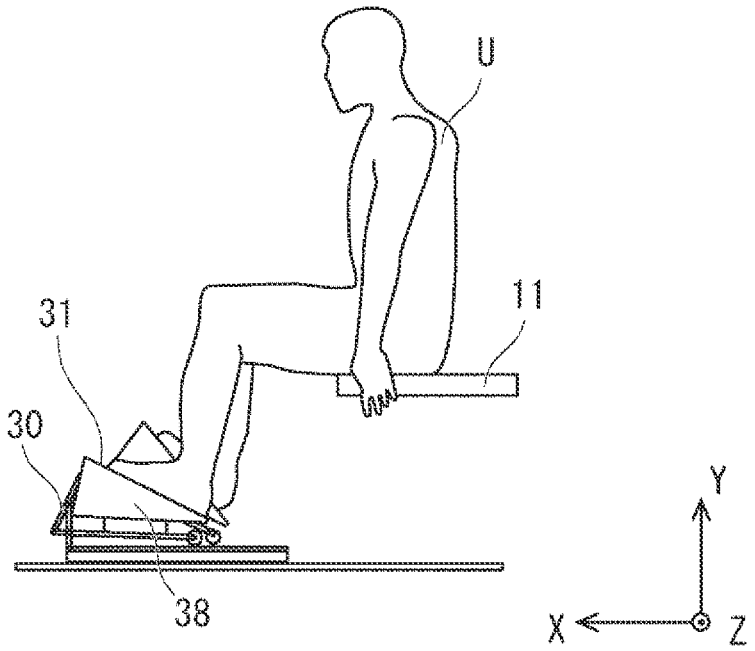
FIG. 6A shows the user's posture when pedals are tilted in a dorsiflexion direction and the distance between the chair and the main body in the anteroposterior direction is normal.
Figure 6B:
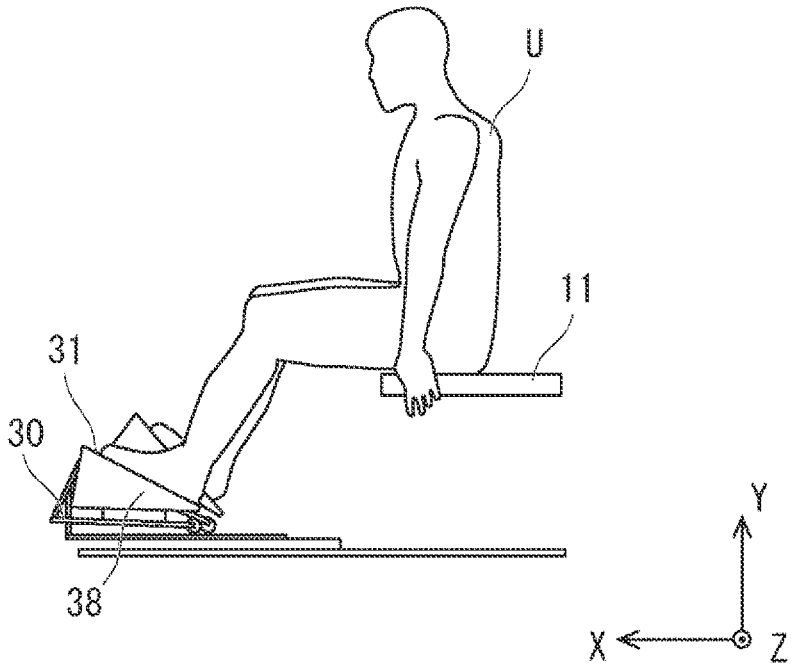
FIG. 6B shows the user's posture when the pedals are tilted in the dorsiflexion direction and the distance between the chair and the main body in the anteroposterior direction is large.

FIGS. 6A and 6B show the user's postures when the pedal 31 is tilted. In FIGS. 6A and 6B, an adjusting member 38 for tilting the pedal 31 is attached to the pedal 31. For example, the angles of the knee joint, the ankle joint, etc. can be adjusted by placing the adjusting member 38 between the pedal 31 and the link 30 shown in FIGS. 1 and 2. FIG. 6A shows the posture when the distance of the chair 10 to the main body 20 is normal. FIG. 6B shows the posture when the distance of the chair 10 to the main body 20 is large.

For example, the adjusting member 38 is a wedge-shaped block. The pedal 31 can be tilted in the dorsiflexion direction by inserting the adjusting member 38 between the pedal 31 and the link 30. The angle of the ankle joint etc. changes according to the installation angle of the pedal 31. Since the ankle joint angle changes according to the installation angle of the pedal 31, the ankle joint can be flexed in the dorsiflexion direction.

In the configurations of FIGS. 6A and 6B, the ankle joint can be flexed in the dorsiflexion direction more than in the configurations of FIGS. 4A to 4C. In FIGS. 4A to 4C, the pedal 31 is not tilted in the dorsiflexion direction because the adjusting member 38 is not placed. In FIGS. 6A and 6B, the pedal 31 is tilted in the dorsiflexion direction as compared to FIGS. 4A to 4C because the adjusting member 38 is placed. Therefore, the posture of the user U changes according to the installation angle of the pedal 31.

The ranges of motion of the knee joint, ankle joint, etc. can be adjusted according to the presence or absence of the adjusting member 38. The ankle joint angle need not necessarily be adjusted by attaching or detaching the adjusting member 38, and may be adjusted by changing the shape of the pedal 31. For example, a wedge-shaped pedal 31 can be used.

When the setting item is the installation angle of the pedal 31, the parameter of the setting item is classified into two levels, "pedal tilt" and "no pedal tilt." That is, for the installation angle of the pedal 31, the recommended setting calculation unit 211 recommends either "pedal tilt" or "no pedal tilt" as a recommended setting. The muscle site that can be built by training and the amount of the load to be placed on the muscle site can thus be changed.

Moreover, preparing a plurality of adjusting members 38 with different angles allows fine adjustment of the ankle joint angle. The assistant etc. may replace the adjusting member 38 according to the user U. For example, when the assistant replaces the adjusting member 38 with another adjusting member 38 with a larger wedge angle, the ankle joint can be flexed more in the dorsiflexion direction. The adjusting member 38 may be installed so as to flex the ankle joint in the plantarflexion direction. For example, the wedge-shaped adjusting member 38 may be inserted in the opposite direction. The adjusting member 38 is not limited to the wedge shape, but may have various shapes.

The tilt angle of the pedal 31 can therefore be finely adjusted by, for example, replacing the adjusting member 38. The range of motion of the ankle joint can be more finely adjusted according to the shape, angle, position, etc. of the adjusting member 38. The angles of the knee joint, the ankle joint, etc. change according to the tilt angle of the pedal 31. Therefore, the ranges of motion of the knee joint, the ankle joint, etc. can be finely adjusted by providing many settings of the installation angle of the pedal 31. That is, the recommended setting calculation unit 211 recommends a numerical value or numerical range of the tilt angle of the pedal 31 as a recommended setting. Alternatively, the recommended setting calculation unit 211 may recommend a numerical value or numerical range of the height or angle of the adjusting member 38 as a recommended setting. The posture and load can thus be set more finely. The muscle site that can be built by training and the amount of load to be placed on the muscle site can be changed by the tilt angle of the pedal 31 and the adjusting member 38. The tilt of the pedal 31 made by the adjusting member 38 is also referred to as pedal tilt.

Figure 7A:
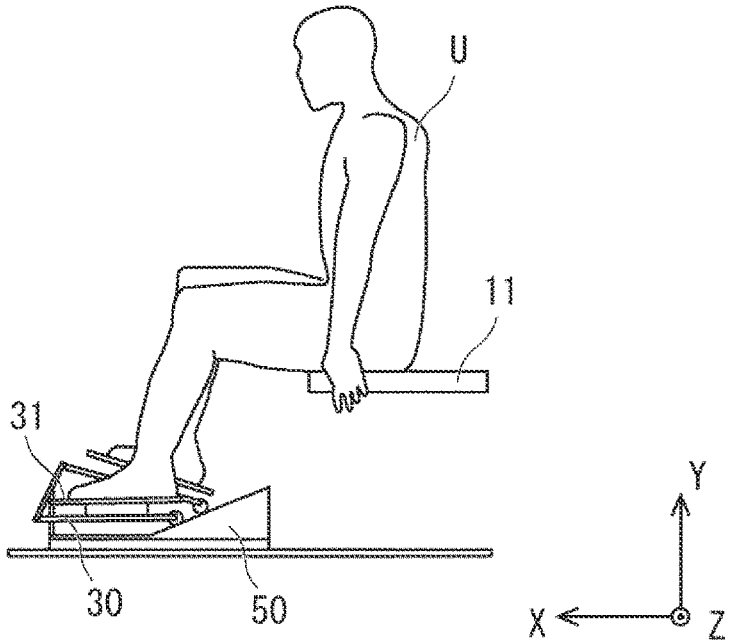
FIG. 7A shows the user's posture when a tilted base is placed and the distance between the chair and the main body in the anteroposterior direction is normal.
Figure 7B:
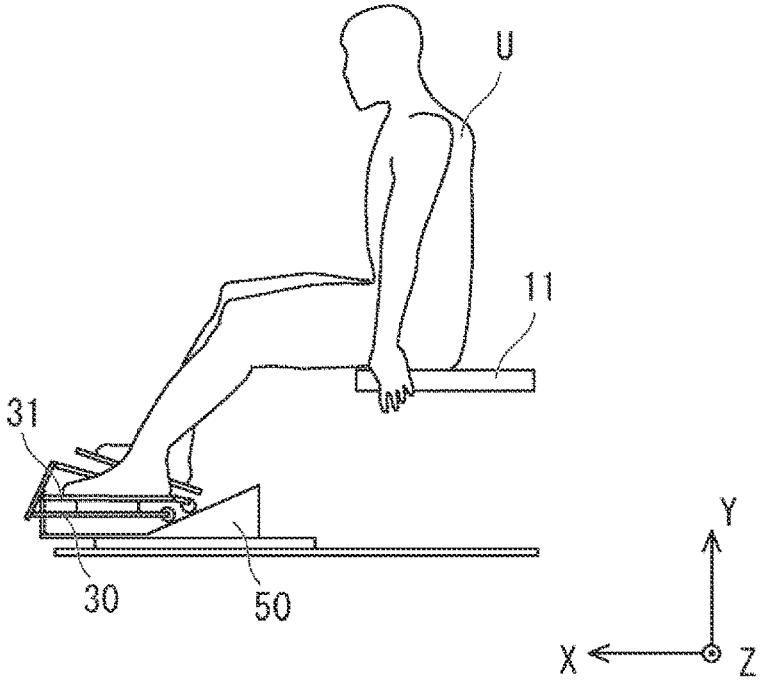
FIG. 7B shows the user's posture when the tilted base is placed and the distance between the chair and the main body in the anteroposterior direction is large.

FIGS. 7A and 7B illustrate the user's postures when the tilted base 50 is placed. FIG. 7A illustrates the posture when the distance of the chair 10 to the main body 20 is normal. FIG. 7B illustrates the posture when the distance of the chair 10 to the main body 20 is large. For example, the tilted base 50 shown in FIGS. 1 and 2 is attached. When there is the tilted base 50, the ankle joint can be flexed in the plantarflexion direction more than when there is no tilted base 50.

The user's posture changes according to the presence or absence of the tilted base 50. The ranges of motion of the knee joint, ankle joint, etc. can be adjusted according to the presence or absence of the tilted base 50. When the setting item is with or without the tilted base 50, the parameter of the setting item is classified into two levels, "with tilted base" and "without tilted base." That is, for this setting item regarding the tilted base 50, the recommended setting calculation unit 211 recommends either "with tilted base" or "without tilted base" as a recommended setting. The muscle site that can be built by training and the amount of the load to be placed on the muscle site can thus be changed.

The user's posture also changes according to the tilt angle of the tilted base 50 and the position of the tilted base 50 in the anteroposterior direction. The tilt angle of the tilted base 50 can be changed by replacing the tilted base 50 with another tilted base 50 with a different tilt angle. The user U can thus perform a pedaling exercise with the ankle joint in an appropriate range of motion. Alternatively, the range of motion of the ankle joint can be set to an appropriate range by changing the position of the tilted base 50 in the anteroposterior direction. The ankle joint angle can thus be more finely adjusted by changing the geometrical position of the tilted base 50. For the setting items regarding the tilted base 50, the recommended setting calculation unit 211 may calculate a numerical value or numerical range of the tilt angle or attachment position (X coordinate) of the tilted base 50 as a recommended setting. The muscle site that can be built by training and the amount of the load to be placed on the muscle site can thus be changed.

The recommended settings need only include parameters of at least a part of the setting items described above. In other words, it is not necessary to change the parameters of all of the setting items described above. That is, one or more of the setting items may not be changed from default settings. The parameters of other setting items may be set to recommended settings. For example, the parameters of the setting items related to a rotational motion of pedaling may be set to recommended settings.

For example, the recommended setting calculation unit 211 stores a recommended setting table as shown in FIG. 8 in the memory etc. In the recommended setting table, the activities of daily living are linked to their recommended settings. The recommended settings shown in FIG. 8 include recommended parameters of only three setting items: installation distance, pedal load, and rotational speed. Therefore, the parameters are fixed for the setting items other than the installation distance, pedal load, and rotational speed.

The installation distance is a relative distance from the main body 20 to the chair 10. The installation distance is a parameter that can be adjusted by changing the distance from the main body 20 to the seat portion 11 of the chair 10. More specifically, the distance from the rotating shaft 21 to the seat portion 11 is defined as the installation distance. The user U etc. can change the installation distance by moving the chair 10 or the main body 20 in the anteroposterior direction. For example, the installation distance can be adjusted in three levels: large, normal, and small. When the installation distance is normal, a lighter load is placed on muscle sites and joints.

The pedal load is a load level applied to the pedal 31, and can be adjusted in five levels of 1 to 5. For example, the amount of load of the pedal 31 is a parameter that can be adjusted by changing the set value of the load resistor of the main body 20. The larger the numerical value of the load level, the heavier the load that is placed on muscle sites and joints. The load to be placed on muscle sites and joints can be adjusted by changing the load resistance of the pedal 31.

The rotational speed corresponds to the rotational speed of the crank 40, and can be adjusted in three levels: high, medium, and low. The higher the rotational speed, the higher the load. The processing system 200 sets, for example, a threshold of the rotational speed for each of high speed, medium speed, and low speed in advance. The processing system 200 compares the rotational speed of the crank 40 with the threshold. When the rotational speed of the crank 40 is different from the recommended setting, the output unit 230, which will be described later, outputs an indication that the rotational speed of the crank 40 is different from the recommended setting. That is, when the rotational speed of the crank 40 is less than the set rotational speed, the output unit 230 may output an alarm. Alternatively, when the rotational speed of the crank 40 is more than the set rotational speed, the output unit 230 may output an alarm.

For example, it is herein assumed that the user data of the user U indicates that the user U cannot go up/down the stairs and can walk. The level of difficulty of walking is higher than the levels of difficulty of walking with assistance, standing up, sitting down, standing up and sitting down with assistance, standing, standing with assistance, and sitting stably. Therefore, the user U can walk with assistance, stand up, sit down, stand up and sit down with assistance, stand, stand with assistance, and sit stably. In this case, the recommended setting calculation unit 211 recommends recommended settings corresponding to walking. Specifically, the recommended setting calculation unit 211 recommends a large installation distance, a pedal load level of 4, and a high rotational speed as recommended settings.

The recommended setting calculation unit 211 thus calculates recommended settings based on the information on what activity of daily living the user U can perform. When the user U can perform a plurality of activities of daily living, the recommended setting calculation unit 211 calculates recommended settings corresponding to the activity of daily living having the highest level of difficulty. That is, the recommended setting calculation unit 211 calculates recommended settings according to the highest load activity of daily living among the activities of daily living the user U can perform.

It is preferable that the processing system 200 prepare a plurality of recommended setting tables according to the physical information. For example, it is preferable to divide a user group into a plurality of groups according to the physical information such as height and set a recommended setting table for each group in advance. Appropriate recommended settings can thus be obtained according to the physique of the user U.

For example, when the height is divided into three groups: tall, medium, and short, the processing system 200 creates in advance a recommended setting table for tall users, a recommended setting table for users of medium height, and a recommended setting table for short users. The height need not necessarily be divided into three groups, and need only be divided into two or more. In addition to the height, other physical information may also be divided into groups. For example, the user group can be divided into groups based on the weight, lower limb length, upper limb length, or trunk length. The user group may be divided into groups based on a plurality of categories.

The processing system 200 creates in advance a plurality of groups according to the physical information. The recommended setting calculation unit 211 stores a recommended setting table for each group. The recommended setting calculation unit 211 selects the group to which the user U belongs based on the physical information indicated by the user data. The recommended setting calculation unit 211 then calculates recommended settings by using the recommended setting table of the group to which the user U belongs. Appropriate recommended settings can thus be calculated according to the physique of the user U.

The output unit 230 outputs the recommended settings calculated by the recommended setting calculation unit 211. The output unit 230 has a display etc. and displays the recommended settings to the user U. Alternatively, the output unit 230 may have a speaker for outputting the recommended settings by voice. The output unit 230 may display an alarm. Alternatively, the output unit 230 may output an alarm sound.

The display of the output unit 230 may display a screen for entering the user data and muscle site data. For example, a touch panel display displays a keyboard or pulldown menu for entering numerical values. Alternatively, the display may display questions for setting the muscle site and the amount of load. Alternatively, the output unit 230 may output questions for setting the muscle site and the amount of load by voice from the speaker. In this case, the user U etc. may input the muscle site the user U wants to build and the amount of load to be placed on the muscle site by voice using a microphone. The display output, the touch panel input, the voice input, and the voice output can be combined as appropriate.

The determination unit 240 determines whether the exerciser 100 is operating with the recommended settings calculated by the recommended setting calculation unit 211. When the exerciser 100 is not operating with the recommended settings, the output unit 230 notifies the user U etc. For example, the output unit 230 may output a warning message, a warning sound, etc. This can facilitate the user U etc. to operate the exerciser 100 with the recommended settings.

For example, the determination unit 240 may include sensors that can detect the position, angle, shape, etc. of equipment. The determination unit 240 determines whether the geometrical arrangement of various pieces of equipment matches the recommended settings, based on the detection results of the sensors. For example, the determination unit 240 may detect the presence or absence of the equipment by a contact sensor etc. Alternatively, the determination unit 240 may detect, for example, the presence or absence of the equipment and the arrangement and tilt angle of the equipment by analyzing an image of the exerciser 100 captured by a camera. The determination unit 240 makes the determination by comparing the results detected by various sensors with the recommended settings.

The simulator 212 calculates muscle activities using, for example, a computer. The simulator 212 calculates muscle activities using a human body computer model (e.g., a human body model such as human body finite element model). For example, by receiving physique data such as height and lengths of lower limb joints, the simulator 212 creates a human body model with that physique and performs a simulation. The simulator 212 can be used to obtain the parameters of the recommended settings. The upper limit of the load on the muscle sites is set based on the simulation results of the simulator 212.

Figure 9:
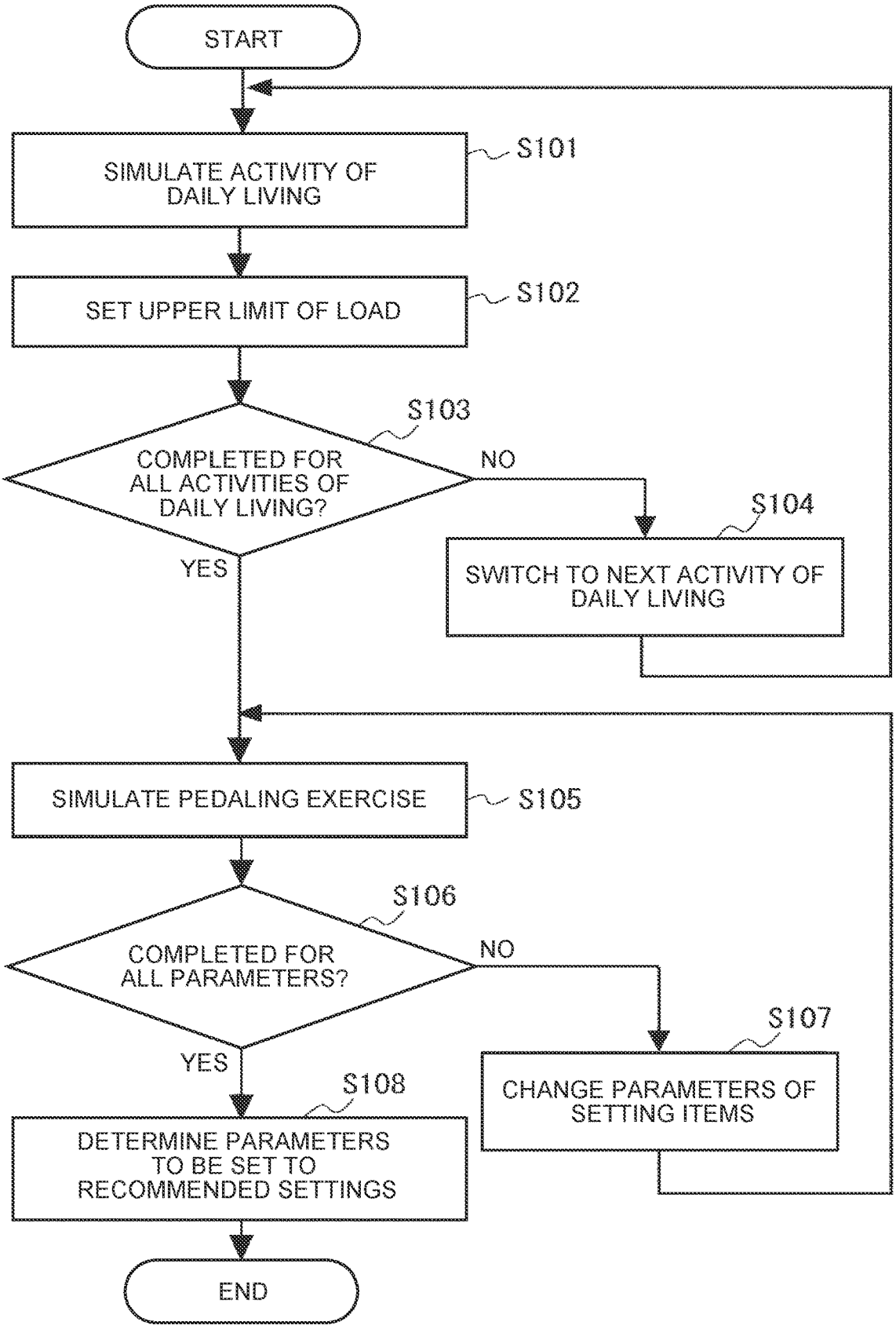
FIG. 9 is a flowchart of a process of obtaining recommended settings.

Hereinafter, an example of a process of creating a recommended setting table will be described with reference to FIG. 9. FIG. 9 is a flowchart of a process of linking the recommended settings to the activities of daily living. The recommended setting table shown in FIG. 8 can be created by performing the process shown in FIG. 9.

First, the simulator 212 simulates an activity of daily living (S101). The simulator 212 calculates the maximum value of the load on the muscle sites based on the simulation result of the activity of daily living. For example, the simulator 212 calculates the maximum value of the load for each muscle site by simulating the motion of going up/down the stairs. The simulator 212 may calculate the load (maximum contact force) placed on the joints.

Next, the simulator 212 sets the upper limit of the load based on the maximum value of the load applied during the motion of going up/down the stairs (S102). The upper limit of the load is set to a value that is not higher than the maximum value of the load applied during the activity of daily living the user can perform. For example, the upper limit of the load is set to 40% of the maximum value of the load. The upper limit of the load may be set for each muscle site or for each joint.

The simulator 212 determines whether the simulator 212 has completed the simulations of all the activities of daily living (S103). When the simulator 212 has not completed the simulations of all the activities of daily living (NO in S103), the simulator 212 switches to the next activity of daily living (S104). Then, the simulator 212 simulates the next activity of daily living (S101) and sets the upper limit of the load (S102). The upper limit of the load is thus set based on the maximum value of the load applied during, for example, the motion of walking. By repeating the above steps, the simulator 212 can set the upper limit of the load for each of the motions of walking, walking with assistance, standing, etc. That is, the simulator 212 can set the upper limit of the load for each activity of daily living.

When the simulator 212 has completed the simulations of all the activities of daily living (YES in S103), the simulator 212 simulates a pedaling exercise (S105). It is preferable that the simulator 212 use the same simulation model for both the simulations of the activities of daily living (step S101) and the simulations of the pedaling exercise (step S105). It is also preferable that the simulations of the pedaling exercise in S105 be performed using the same physical information data as in the simulations of the activities of daily living in S101.

In step S105, the simulator 212 calculates a change in muscle activity of each muscle caused by the pedaling exercise. The simulator 212 calculates a change in muscle activity with time during one rotation time. The simulator 212 calculates the load placed on the muscle sites by the pedaling exercise. The load placed by the pedaling exercise may be calculated for each muscle site. The simulator 212 may also calculate the load (maximum contact force) placed on the joints.

The simulator 212 then determines whether the simulator 212 has completed the simulations for all the parameters (S106). When the simulator 212 has not completed the simulations for all the parameters (NO in S106), the simulator 212 changes the parameters of the setting items (S107). The routine then returns to S105, and the simulator 212 simulates the pedaling exercise. For example, when the installation distance can be adjusted in three levels, the pedal load can be adjusted in five levels, and the rotational speed can be adjusted in three levels, the simulator 212 simulates the pedaling exercise 45 times (=3×5×3).

When the simulator 212 has completed the simulations for all the parameters (YES in S106), the simulator 212 determines the parameters to be set to recommended settings (S108). The simulator 212 compares the load obtained by the simulations of the pedaling exercise with the upper limit set in S102, and sets the recommended settings so that the load does not become higher than the upper limit. In other words, the parameters of the pedaling exercise whose simulation result shows that the load is not higher than the upper limit are set to the recommended settings. When there is a plurality of simulation results showing that the load is not higher than the upper limit, the simulator 212 may set the parameters of the pedaling exercise whose simulation result shows that the load is closest to the upper limit to the recommended settings. The parameters whose simulation result shows that the load on each muscle site is equal to or less than the upper limit are saved as the recommended settings. The recommended settings can thus be linked to each activity of daily living. The recommended setting parameters shown in FIG. 8 can be set in this manner.

The processing system 200 calculates by simulations the maximum value of the load placed on the muscle sites during the activity of daily living that the user can perform. The processing system 200 obtains the upper limit of the load based on the maximum value of the load. That is, the processing system 200 sets such an upper limit of the load that is not higher than the maximum value of the load placed on the muscle sites during the activity of daily living. The user U can thus perform a pedaling exercise with the set parameters suitable for him or her. The user U can therefore train effectively. An excessive load can thus be suppressed from being placed on the user U, so that the user U can thus stably perform safe training.

Simulations need not necessarily be performed for all parameters. For example, the process may be ended when the recommended settings for each activity of daily living are determined. In the above description, one set of recommended settings is linked to each activity of daily living. However, a plurality of sets of recommended settings may be linked to each activity of daily living. In this case, the user U etc. can select a more appropriate set of recommended settings from the sets of recommended settings. The user U can thus perform a pedaling exercise with the set parameters suitable for him or her. The user U can therefore train effectively.

Hereinafter, the load obtained from the simulations by the simulator 212 will be described.

A change in load when the installation distance is changed will be described with reference to FIGS. 10 to 16. FIGS. 10 to 16 show the simulation results when the simulation conditions regarding the setting items are changed as shown in FIGS. 4A to 7B. In FIGS. 4A to 4C, the parameter of the installation distance is changed to normal distance, short distance, and long distance. The settings at the normal distance shown in FIG. 4A are default settings, and the parameters of the default settings are used unless otherwise specified. The default settings are "without installation base," "no pedal tilt," and "without tilted base."

The load simulation results are shown for a standing-up motion and a gait initiation motion as activities of daily living. The simulator 212 calculates the maximum contact forces applied to the hip joint, knee joint, and ankle joint. It is herein assumed that the load of the pedaling motion at the normal distance is 1.

The load during the gait initiation motion is higher than that during the standing-up motion. The load is higher when the installation distance is large than when the installation distance is normal. Therefore, when the user U can perform activities of daily living having high levels of difficulty, the installation distance can be set to large in order to increase the load.

In FIGS. 5A and 5B, the parameter of the installation distance is changed between normal and large with the setting of "with installation base." In FIGS. 6A and 6B, the parameter of the installation distance is changed between normal and large with the setting of "pedal tilt." In FIGS. 7A and 7B, the parameter of the installation distance is changed between normal and large with the setting of "with tilted base." In FIGS. 10 to 16, the load during the standing-up motion and the load during the gait initiation motion are shown for comparison.

Figure 10:
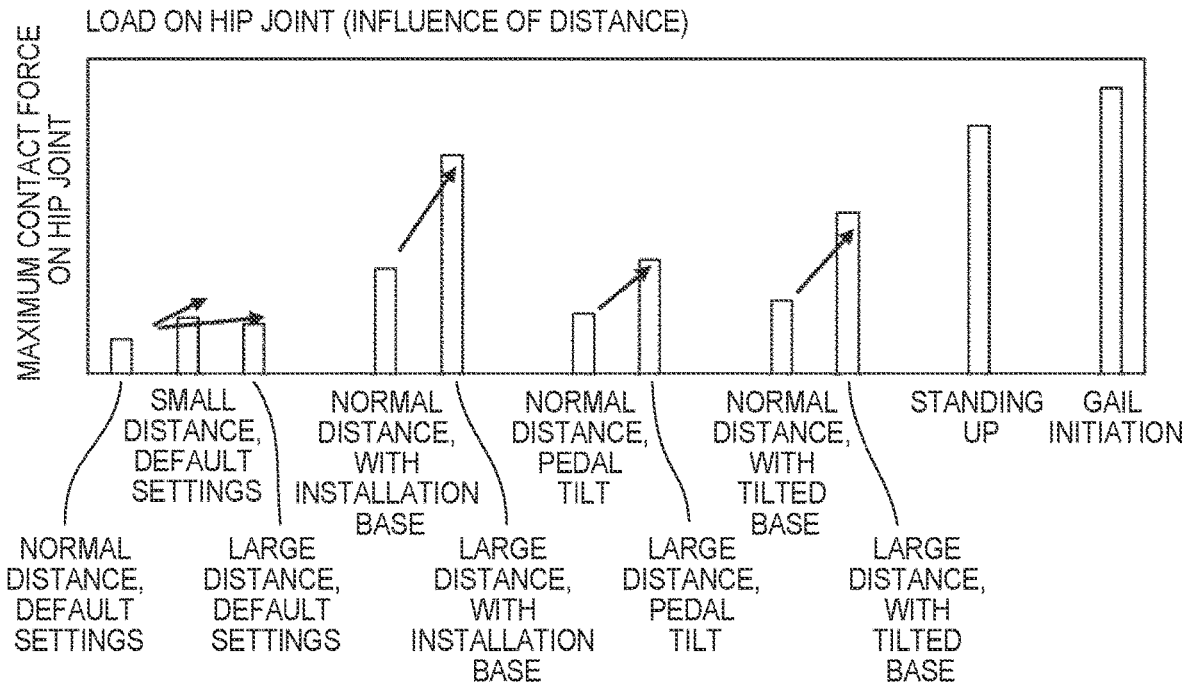
FIG. 10 is a graph showing simulation results of a load (maximum contact force) placed on a hip joint.
Figure 11:
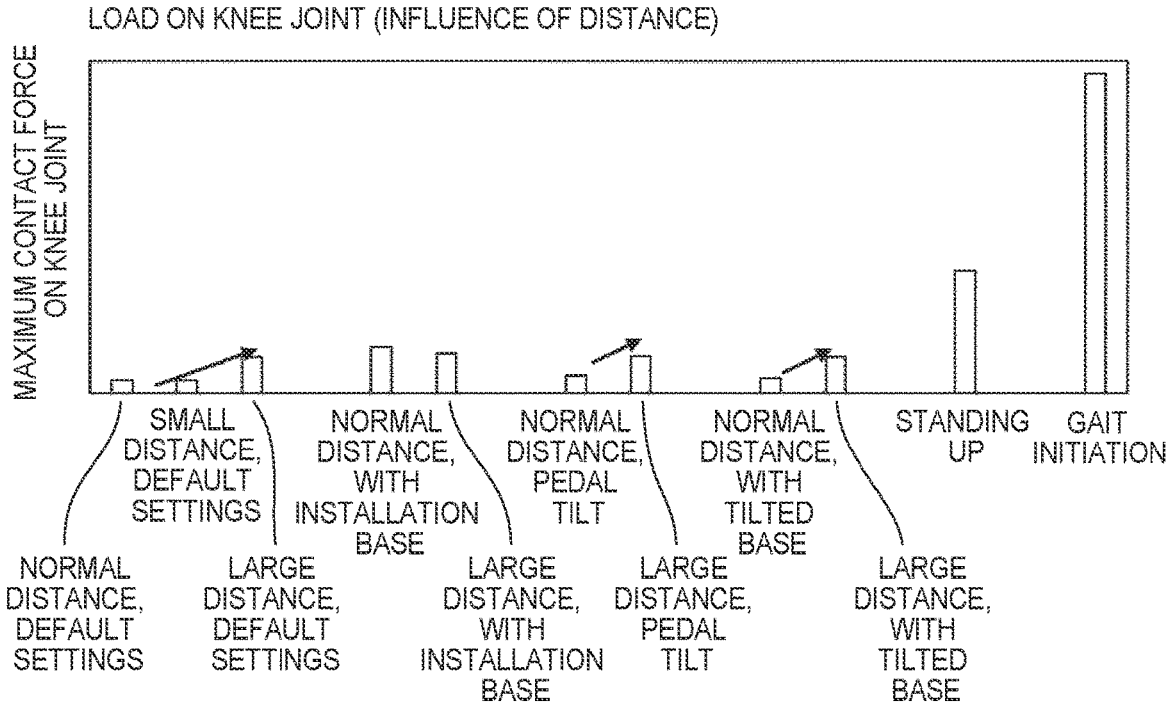
FIG. 11 is a graph showing simulation results of a load (maximum contact force) placed on a knee joint.
Figure 12:
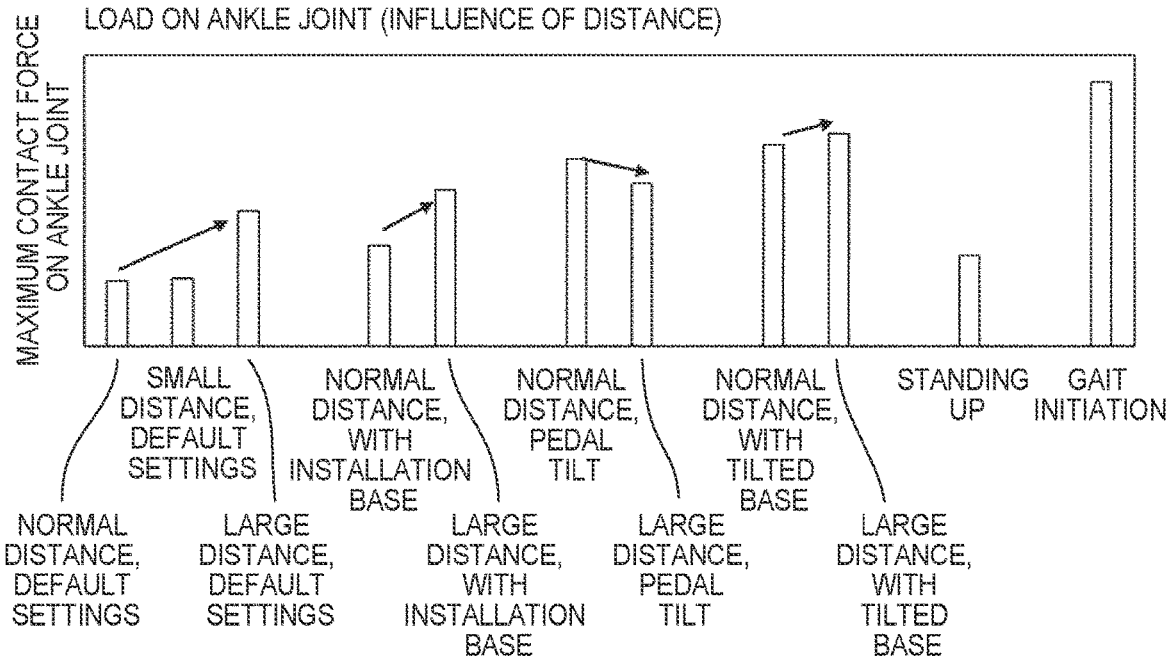
FIG. 12 is a graph showing simulation results of a load (maximum contact force) placed on an ankle joint.
Figure 13:
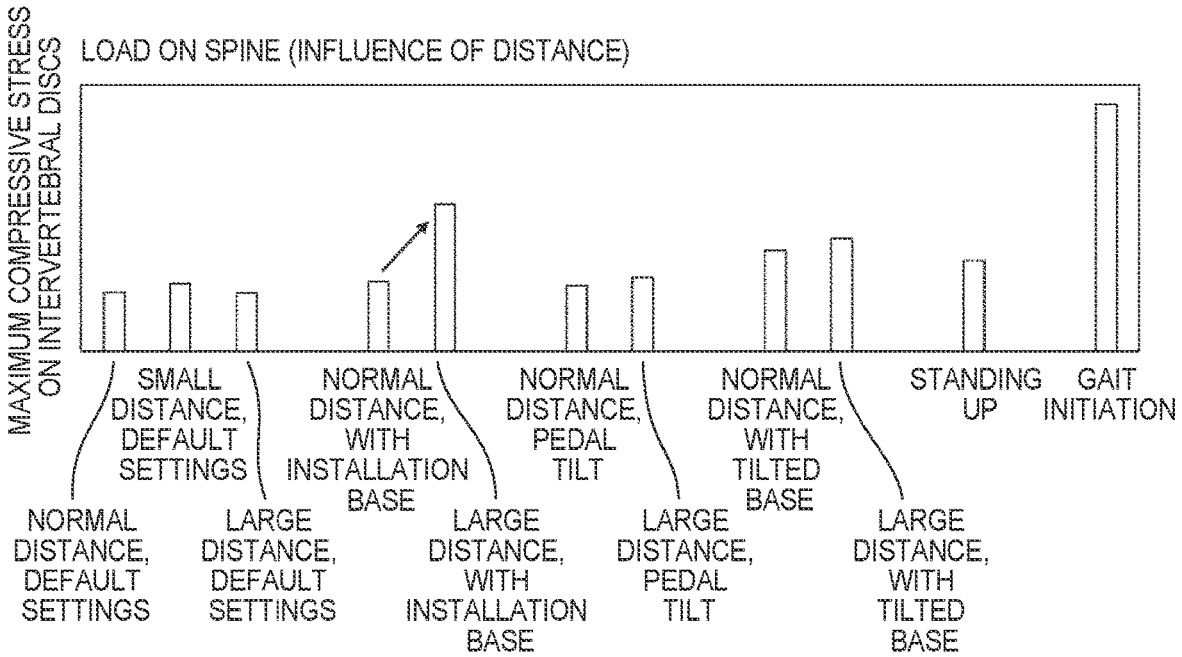
FIG. 13 is a graph showing simulation results of a load (maximum compressive stress on intervertebral discs) placed on a spine.
Figure 14:
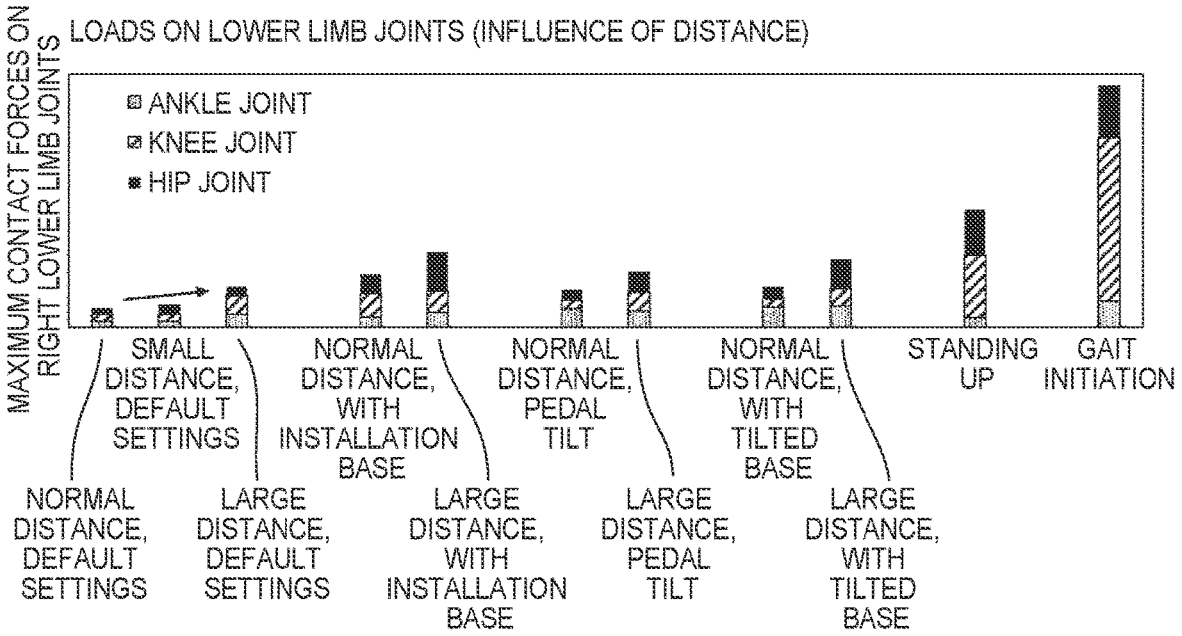
FIG. 14 is a graph showing simulation results of loads (maximum contact forces) placed on lower limb joints.

FIGS. 10 to 13 are graphs showing a change in load caused by the installation distance. FIGS. 10 to 12 are graphs showing the maximum contact forces applied to the hip joint, knee joint, and ankle joint, respectively. FIG. 13 is a graph showing the maximum compressive stress on the intervertebral discs. FIG. 14 is a graph showing the loads (maximum contact forces) placed on the right lower limb joints (ankle joint, knee joint, and hip joint).

Figure 15:
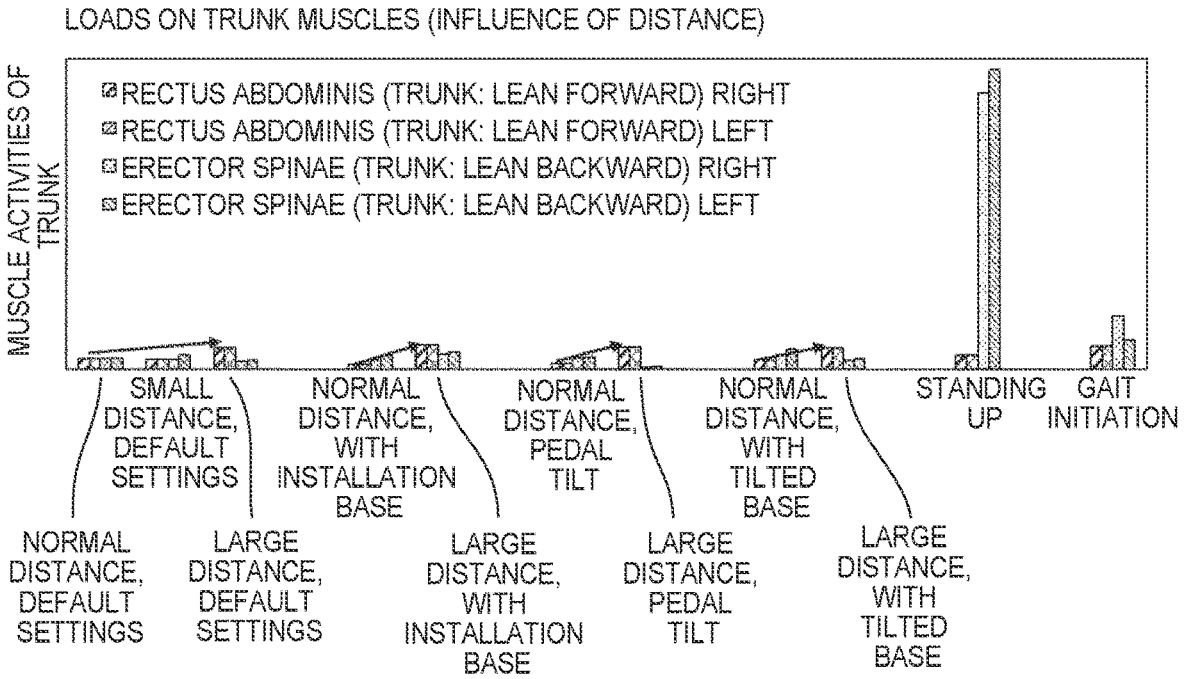
FIG. 15 is a graph showing simulation results of loads placed on muscle sites of a trunk.
Figure 16:
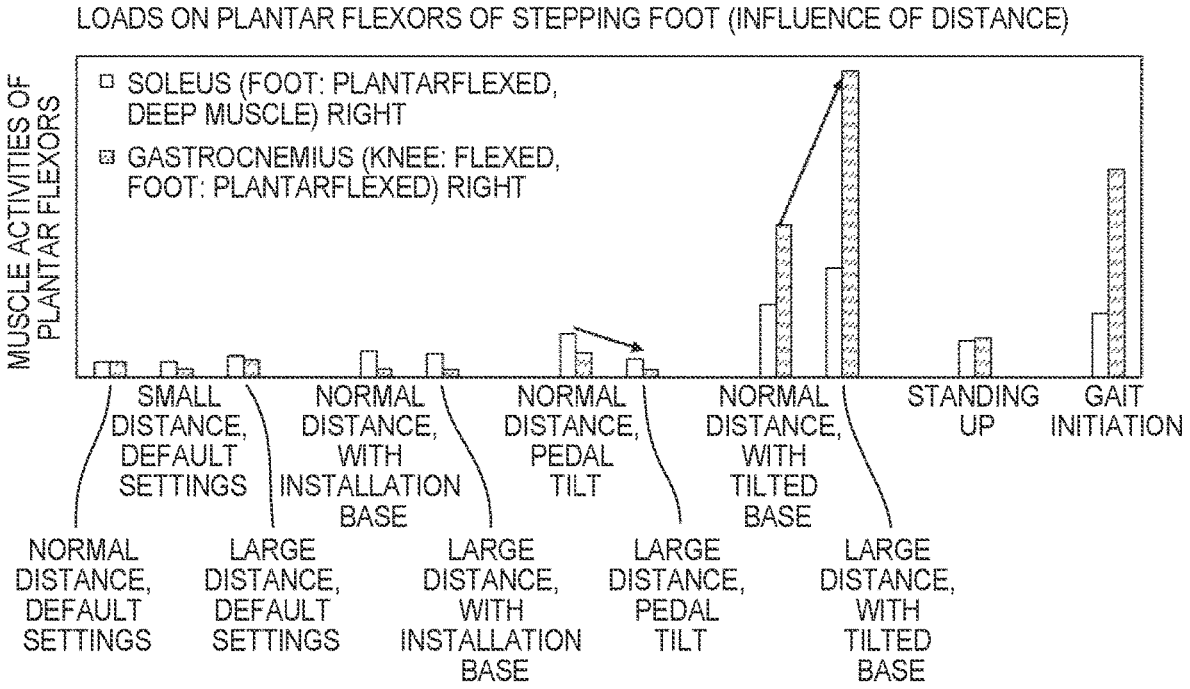
FIG. 16 is a graph showing simulation results of loads placed on plantar flexors.

FIG. 15 is a graph showing the loads placed on the muscles of the trunk. FIG. 16 is a graph showing the loads placed on the plantar flexors of a stepping foot. FIG. 15 shows the muscle activities of the right and left rectus abdominis muscles and the right and left erector spinae muscles. FIG. 16 shows the muscle activities of the soleus and the gastrocnemius.

As shown in FIG. 10, by setting the installation distance to large, the load on the hip joint can be increased as compared to when the installation distance is normal. When the installation distance is changed from normal to small with the default settings, the load on the hip joint is also increased.

As shown in FIG. 11, by setting the installation distance to large, the load on the knee joint can be increased as compared to when the installation distance is normal. However, in the case of "with installation base," the load is lower when the installation distance is large than when the installation distance is normal.

As shown in FIG. 12, the load on the ankle joint can be increased by setting the installation distance to large. However, in the case of "pedal tilt," the load is lower when the installation distance is large than when the installation distance is normal.

As shown in FIG. 13, the load on the spine does not change so much even when the installation distance is changed. However, in the case of "with installation base," the load is higher when the installation distance is large than when the installation distance is normal. Moreover, the load placed by the pedaling exercise is about the same as that placed by the standing-up motion, and is smaller than that placed by the gait initiation motion.

As shown in FIG. 14, the overall load on the lower limb joints is higher when the installation distance is large than when the installation distance is normal. The overall load on the lower limb joints is lower than the overall loads on the lower limb joints placed by the standing-up motion and the gait initiation motion.

As shown in FIG. 15, the muscle activities of the rectus abdominis muscles (abdominal muscles) increase when the installation distance is set to large. The muscle activities (loads) of the rectus abdominis muscles are about the same as those during the standing-up motion and the gait initiation motion. The muscle activities of the erector spinae muscles (back muscles) are lower than those during the standing-up motion and the gait initiation motion.

As shown in FIG. 16, in the case of "pedal tilt," the muscle activities (loads) of the plantar flexors decrease when the installation distance is set to large. In the case of "with tilted base," the muscle activities increase to values higher than those during the gait initiation motion when the installation distance is set to large. In the case of "without tilted base," the loads placed by the pedaling exercise are lower than those placed by the standing-up motion and the gait initiation motion.

Changes in load when the geometrical arrangement is changed will be described with reference to FIGS. 17 to 22. FIGS. 17 to 22 show simulation results when the simulation conditions regarding the setting items are changed. FIGS. 17 to 22 are graphs showing the load in the case where the default settings are changed to "with installation base," "pedal tilt," and "tilted base." FIGS. 17 to 22 also show the load in the case of the large installation distance with "no tilt," "with installation base," "pedal tilt," and "with tilted base." In FIGS. 17 to 22, the load placed by the standing-up motion and the load placed by the gait initiation motion are shown for comparison.

Figure 17:
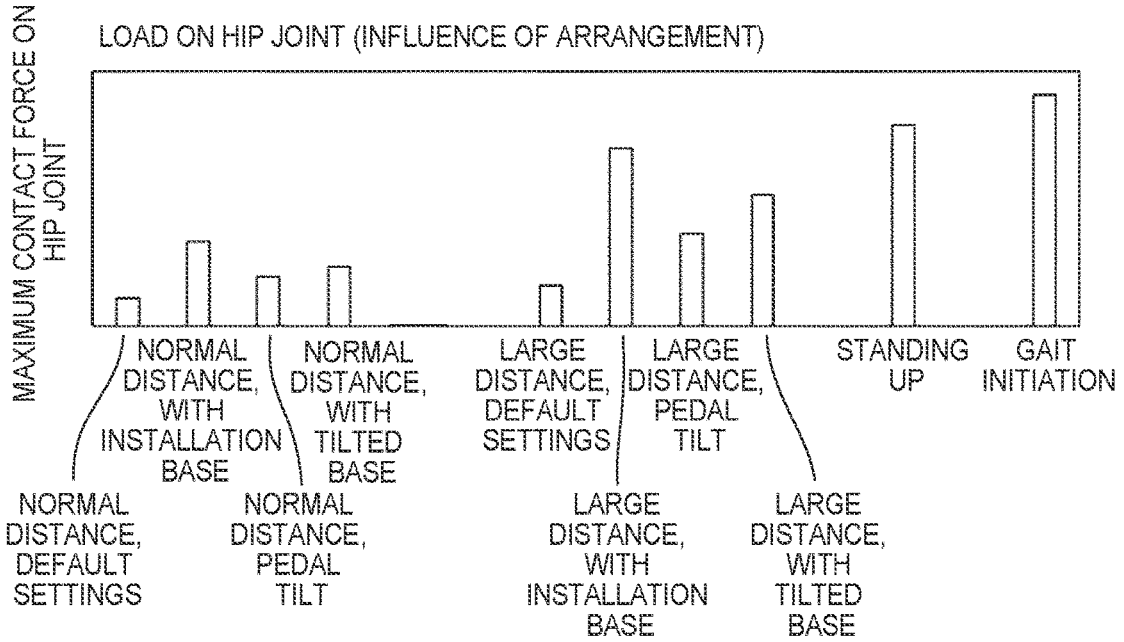
FIG. 17 is a graph showing simulation results of a load (maximum contact force) placed on a hip joint.
Figure 18:
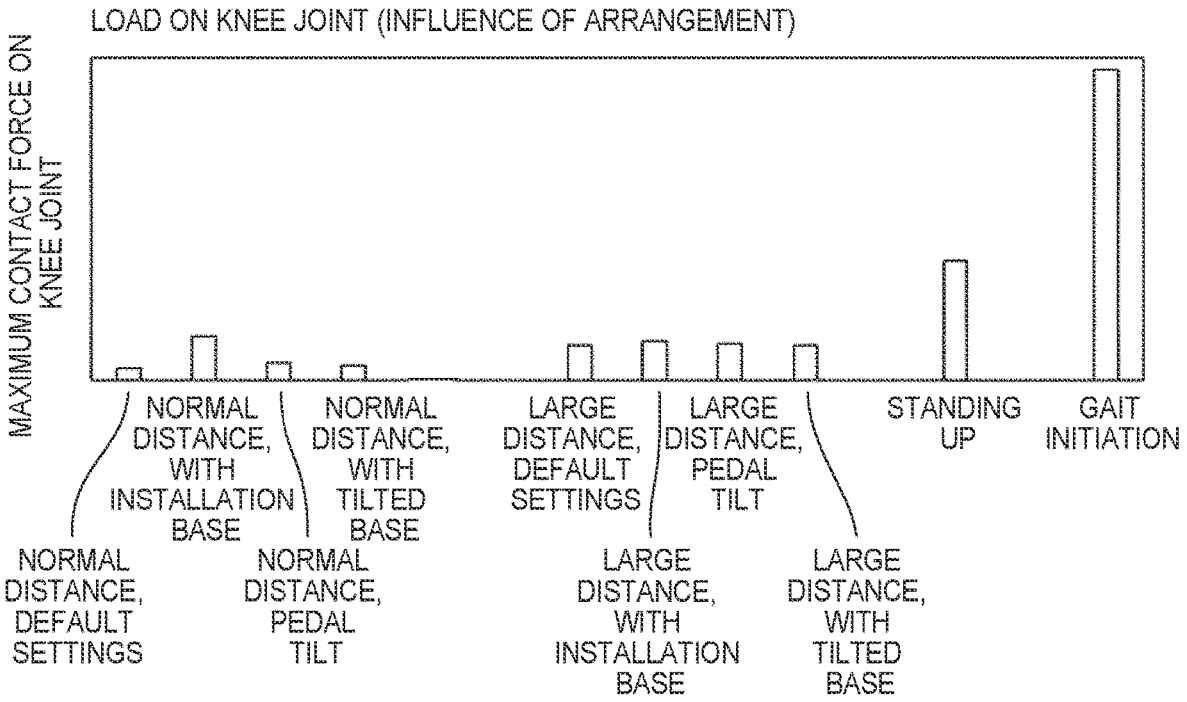
FIG. 18 is a graph showing simulation results of a load (maximum contact force) placed on a knee joint.
Figure 19:
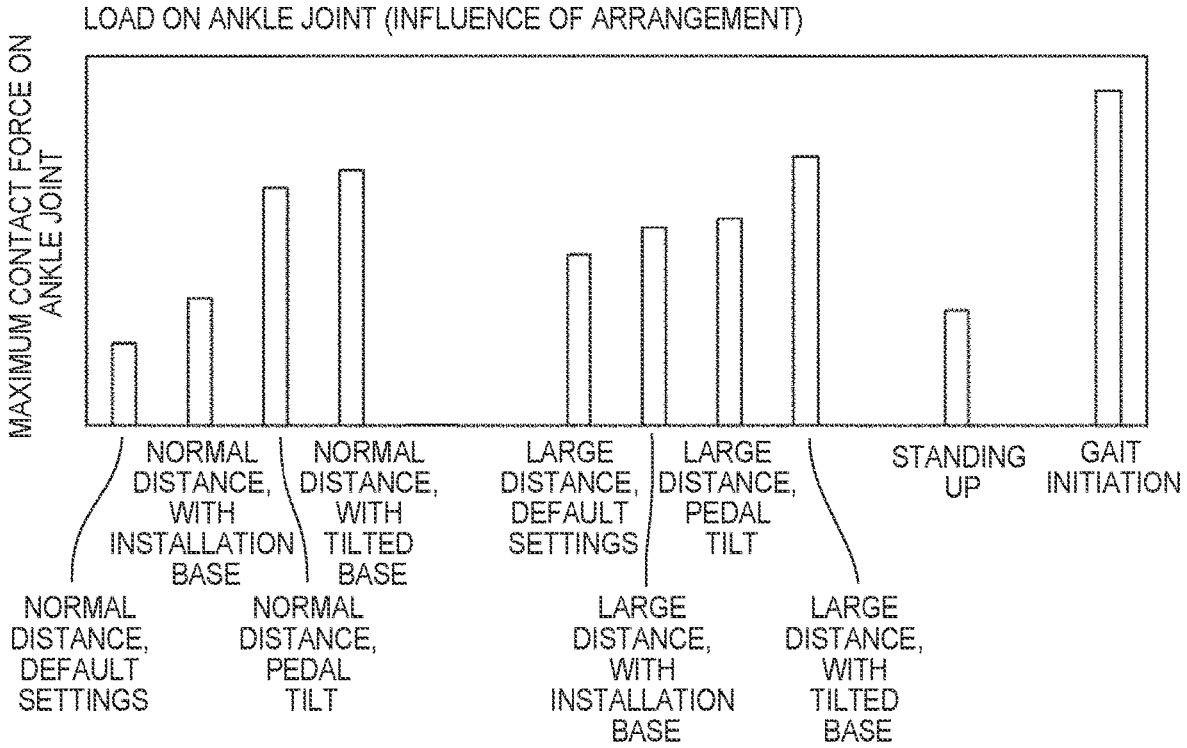
FIG. 19 is a graph showing simulation results of a load (maximum contact force) placed on an ankle joint.
Figure 20:
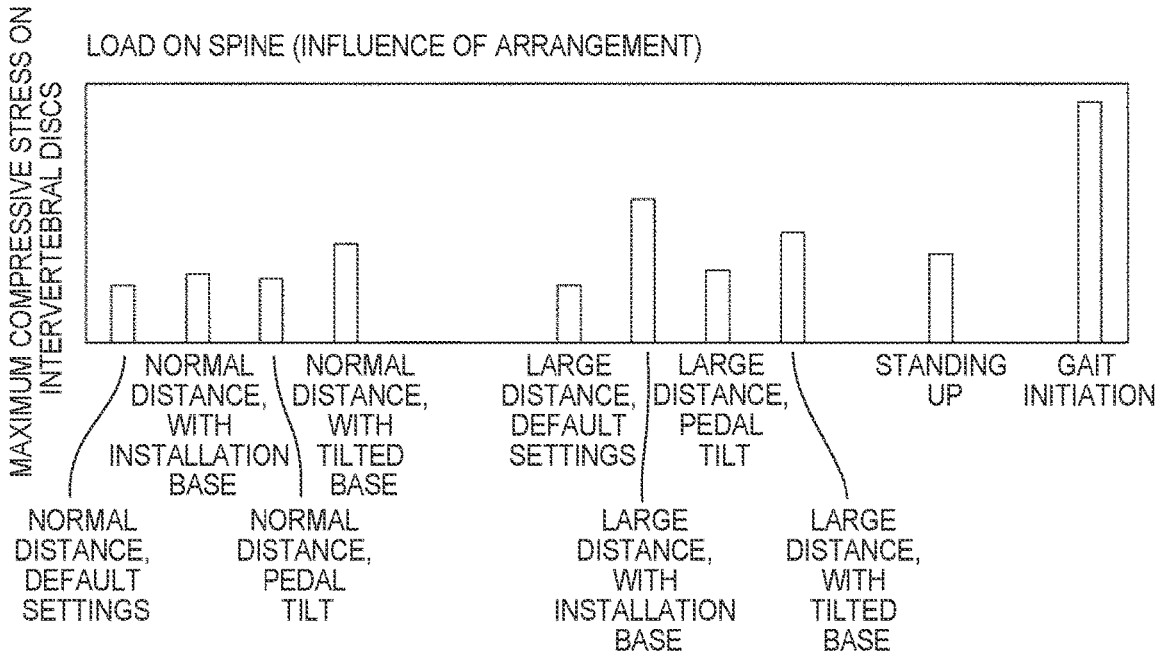
FIG. 20 is a graph showing simulation results of a load (maximum compressive stress on intervertebral discs) placed on a spine.
Figure 21:
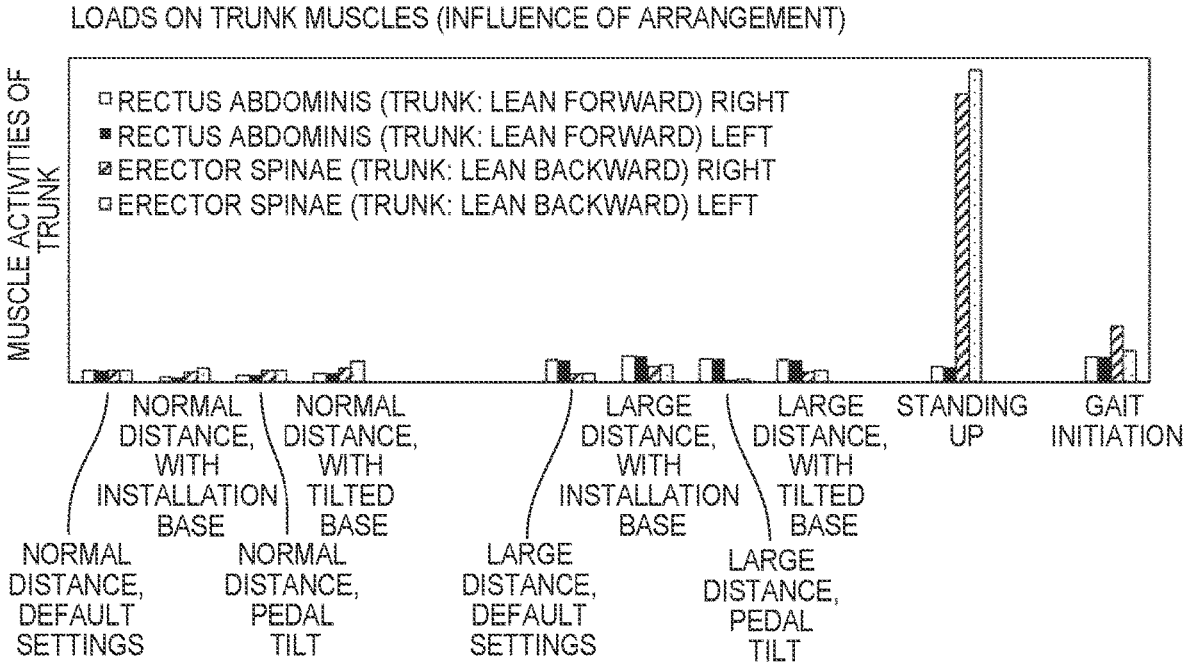
FIG. 21 is a graph showing simulation results of loads placed on muscle sites of a trunk.
Figure 22:
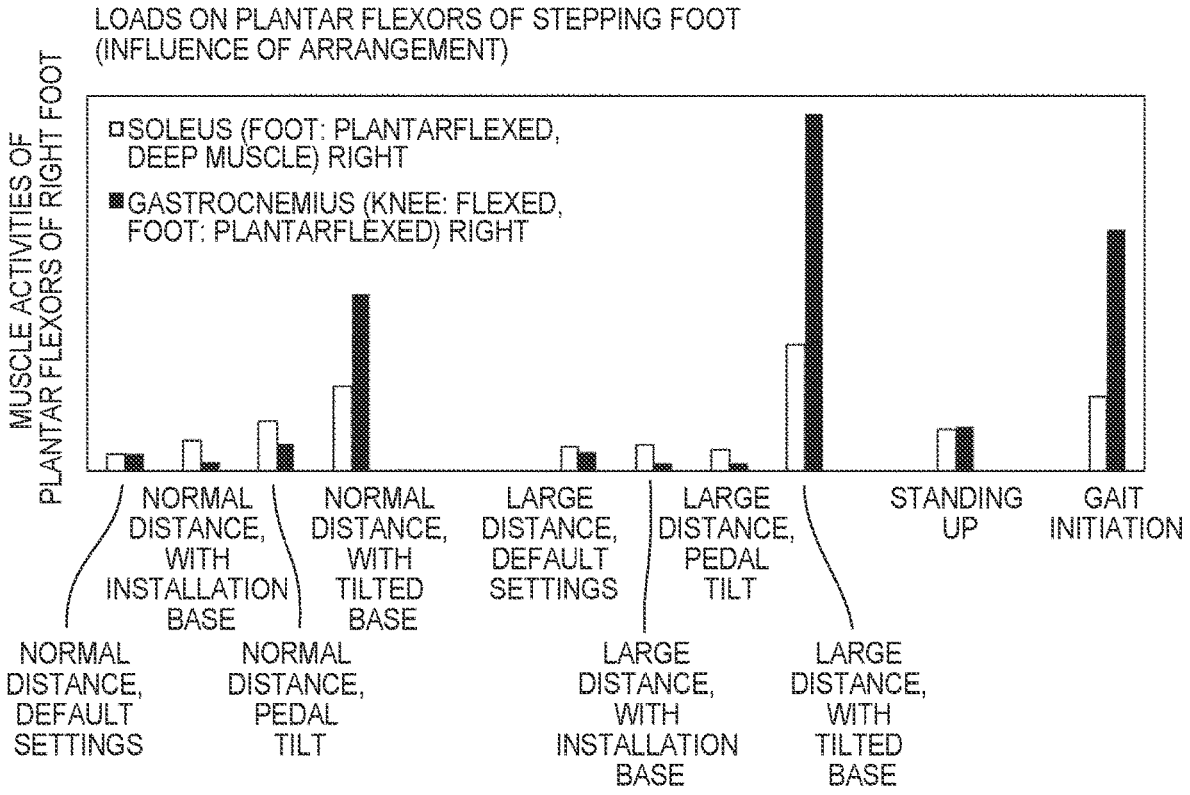
FIG. 22 is a graph showing simulation results of loads placed on plantar flexors.

FIGS. 17 to 22 are graphs showing changes in load caused by the geometrical arrangement. FIGS. 17 to 19 are graphs showing the maximum contact forces applied to the hip joint, knee joint, and ankle joint, respectively. FIG. 20 is a graph showing the maximum compressive stress on the intervertebral discs. FIG. 21 is a graph showing the loads on the muscles of the trunk. FIG. 22 is a graph showing the loads placed on the plantar flexors of a stepping foot. FIG. 21 shows the muscle activities of the right and left rectus abdominis muscles and the right and left erector spinae muscles. FIG. 22 shows the muscle activities of the soleus and the gastrocnemius.

As shown in FIG. 17, regardless of whether the installation distance is normal or large, the load (maximum contact force) on the hip joint is higher in the case of "with installation base" than in the other cases ("default settings," "pedal tilt," and "with tilted base"). The difference in load caused by the geometrical arrangement is large. For any of the parameters, the load placed on the hip joint is lower than the loads placed on the hip joint by the standing-up motion and the gait initiation motion.

As shown in FIG. 18, the load (maximum contact force) placed on the knee joint in the case of "normal distance, with installation base" is about the same as the load (maximum contact force) placed on the knee joint in the case of "large distance, default settings." When the installation distance is large, the difference in load on the knee joint caused by the geometrical arrangement is small. For any of the parameters, the load placed on the knee joint is lower than the loads placed on the knee joint by the standing-up motion and the gait initiation motion.

As shown in FIG. 19, the load (maximum contact force) on the ankle joint is larger in the case of "with tilted base." With the settings other than the default settings, the load placed on the ankle joint is higher than the load placed on the ankle joint by the standing-up motion. For any of the parameters, the load placed on the ankle joint is lower than the load placed on the ankle joint by the gait initiation motion.

As shown in FIG. 20, when the installation distance is normal, the load placed on the spine (maximum compressive stress on the intervertebral discs) is higher in the case of "with tilted base." When the installation distance is large, the load placed on the spine is higher in the case of "with installation base" and "with tilted base." The load placed on the spine is about the same as the load placed on the spine by the standing-up motion, and is lower than the load placed on the spine by the gait initiation motion.

As shown in FIG. 21, when the installation distance is normal and large, the difference in muscle activities of the rectus abdominis muscles (abdominal muscles) caused by the geometrical arrangement is small. The muscle activities (loads) of the rectus abdominis muscles are about the same as the muscle activities (loads) of the rectus abdominis muscles during the standing-up motion and the gait initiation motion. The muscle activities of the erector spinae muscles (back muscles) are lower than the muscle activities (loads) of the rectus abdominis muscles during the standing-up motion and the gait initiation motion.

As shown in FIG. 22, when the installation distance is normal and large, the muscle activities of the plantar flexors are higher in the case of "with tilted base" than in the case of "default settings." When the installation distance is normal, the muscle activity of the gastrocnemius is higher in the case of "with tilted base" than the muscle activity of the gastrocnemius during the standing-up motion and lower than the muscle activity of the gastrocnemius during the gait initiation motion. When the initiation distance is large, the activity of the gastrocnemius is higher in the case of "with tilted base" than both the activity of the gastrocnemius during the standing-up motion and the activity of the gastrocnemius during the gait initiation motion.

The loads applied to the muscle sites and the joints are thus changed by changing the geometrical arrangement of the exerciser 100. By performing simulations with various arrangements in advance by the simulator 212, the recommended setting calculation unit 211 can present appropriate recommended settings. That is, it is possible to set such parameters of the setting items that the load applied by the pedaling exercise is not higher than the load applied by the activities of daily living. Since the simulator 212 can calculate the load for each joint or for each muscle site, the recommended settings can be more appropriately presented.

It is preferable that the recommended setting calculation unit 211 calculate the recommended settings for setting the installation distance from the rotating shaft to the seat portion for the pedaling exercise. It is also preferable that the recommended setting calculation unit 211 calculate the recommended settings for setting the load resistance of the pedal 31. The load can thus be easily adjusted.

The processing system 200 may be shared by a plurality of exercisers 100. That is, one computer may be installed as the processing system 200 in a rehabilitation center etc. where a plurality of exercisers 100 is installed. The one computer serving as the processing system 200 can calculate recommended settings for the exercisers 100. The processing of the recommended setting calculation unit 211 and the simulator 212 may be performed by a server device, and the processing of the input unit 201 and the output unit 230 may be performed by an edge device or terminal on the user U side. The human body computer model is not limited to the human body finite element model, and may be other human body models.

A part or all of the above processing of the processing system 200 etc. can be implemented as a computer program. Such a program can be stored using various types of non-transitory computer-readable media (non-transitory storage media) and supplied to a computer. The non-transitory computer-readable media include various types of tangible recording media. Examples of the non-transitory computer-readable media include magnetic recording media (e.g. flexible disks, magnetic tapes, and hard disk drives), magneto-optical recording media (e.g. magneto-optical disks), compact disc read-only memory (CD-ROM), compact disc recordable (CD-R), compact disc rewritable (CD-RW), and semiconductor memories (e.g. mask ROM, programmable ROM (PROM), erasable PROM (EPROM), flash ROM, random access memory (RAM)). The program may also be supplied to the computer by various types of transitory computer-readable media. Examples of the transitory computer-readable media include electrical signals, optical signals, and electromagnetic waves. The transitory computer-readable media can supply the program to the computer via a wired communication path such as electric wire and optical fiber, or a wireless communication path.

The present disclosure is not limited to the above embodiment, and can be modified as appropriate without departing from the spirit and scope of the present disclosure.

What is claimed is:

1. A method comprising:

calculating a recommended setting of a pedal exerciser that places a load on a muscle of the user, based on the user data, the pedal exerciser being used for a pedaling exercise by the user while the user is seated on a seat portion, the recommended setting including (i) a horizontal installation distance from a rotating shaft to the seat portion for the pedaling exercise and (ii) a recommendation of whether to use an installation base that is placed under the pedal exerciser;

outputting the recommended setting;

adjusting, by the user, the pedal exerciser based on the recommended setting;

detecting, via one or more sensors, an adjustment of the pedal exerciser after the adjusting by the user;

determining whether the pedal exerciser is operating with the recommended setting by comparing sensor data from the one or more sensors with the recommended setting; and in response to determining that the pedal exerciser is not operating with the recommended setting, outputting at least one of a warning message or a warning sound.

2. The processing method according to claim 1, further comprising:

calculating an upper limit of the load that is placed on the muscle of the user, based on the activity of daily living the user is able to perform; and calculating the recommended setting of the pedal exerciser based on the upper limit of the load.

3. The processing method according to claim 2, further comprising obtaining the upper limit of the load from a simulation result of a load that is placed on a muscle site or joint when the user performs the activity of daily living, wherein the user data includes physical information of the user.

4. The processing method according to claim 3, further comprising setting the recommended setting in such a way that a load obtained by simulating a pedaling exercise is not higher than the upper limit.

5. The processing method according to claim 4, further comprising calculating load resistance of a pedal for the pedaling exercise.

6. The method according to claim 1, wherein the recommended setting includes height and position of the installation base such that an angle of the pedal exerciser is adjusted.

7. The method according to claim 1, wherein the user data includes information indicating whether the user is able to go up or down stairs, whether the user is able to walk, whether the user is able to walk with assistance, whether the user is able to stand up, and whether the user is able to sit down.

8. The method according to claim 7, wherein the activity of daily living comprises an activity performed by the user without using the pedal exerciser while the user is away from the pedal exerciser.

* * * * *